US011450969B1

(12) United States Patent
Hussain

(10) Patent No.: US 11,450,969 B1
(45) Date of Patent: Sep. 20, 2022

(54) COMPACT SLOT-BASED ANTENNA DESIGN FOR NARROW BAND INTERNET OF THINGS APPLICATIONS

(71) Applicant: KING FAHD UNIVERSITY OF PETROLEUM AND MINERALS, Dhahran (SA)

(72) Inventor: Rifaqat Hussain, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 17/829,545

(22) Filed: Jun. 1, 2022

(51) Int. Cl.
*H01Q 13/10* (2006.01)
*H01Q 13/16* (2006.01)
*H01P 3/08* (2006.01)

(52) U.S. Cl.
CPC ..... *H01Q 13/16* (2013.01); *H01P 3/081* (2013.01)

(58) Field of Classification Search
CPC ..... H01Q 1/36; H01Q 1/38; H01Q 13/10; H01Q 13/16; H01Q 13/18; H01P 3/08; H01P 3/081
See application file for complete search history.

(56) References Cited

U.S. PATENT DOCUMENTS 6,392,609 B2 * 5/2002 Nieminen ..... H01Q 9/0407 343/700 MS
6,509,879 B2 * 1/2003 Cassel ..... H01Q 13/16 343/746
6,664,931 B1 12/2003 Nguyen et al.
7,345,647 B1 * 3/2008 Rodenbeck ..... H01Q 1/2208 343/895
8,933,842 B2 * 1/2015 Ayatollahi ..... H01Q 21/28 343/700 MS
9,178,270 B2 * 11/2015 Vanjani ..... H01Q 1/243
10,886,621 B2 * 1/2021 Tanaka ..... H01Q 1/36
2013/0063313 A1 3/2013 Ban et al.

OTHER PUBLICATIONS

Hussain, et al. ; Design and Analysis of a Miniaturized Meandered Slot-Line-Based Quad-Band Frequency Agile MIMO Antenna ; IEEE Transactions on Antennas and Propagation, vol. 68, Issue 3 ; pp. 2410-2415 ; Oct. 1, 2019 ; 3 Pages.
Rouissi, et al. ; Design of Frequency Reconfigurable Multiband Meander Antenna Ysing Vacator Diode for Wireless Communication ; International Journal of advanced computer science and applications, The science and information organization, 8 (3) ; 2017 ; 7 Pages.

* cited by examiner

*Primary Examiner* — Tho G Phan
(74) *Attorney, Agent, or Firm* — Oblon, McClelland, Maier & Neustadt, L.L.P.

(57) ABSTRACT

A frequency reconfigurable miniaturized folded slot-based antenna for use with Internet of Things (IoT) devices. The antenna resonates at a lower band in the sub GHz range, and in an upper band at a low GHz range of 1 to 2 GHz. A front and a back side of a dielectric circuit board of the antenna includes a first metallic layer and a second metallic layer, respectively. Each metallic layer includes a meandering slot having a first and second plurality of connected legs, including at least a first leg, a center leg, and a last leg, respectively, where the first leg and the last leg wrap around the dielectric circuit board from the first metallic layer to the second metallic layer. The first metallic layer includes a varactor diode, a first choke and a second choke, and an open-ended microstrip transmission line for receiving signals from a feed line.

20 Claims, 10 Drawing Sheets

COMPACT SLOT-BASED ANTENNA DESIGN FOR NARROW BAND INTERNET OF THINGS APPLICATIONS

BACKGROUND

Technical Field

The present disclosure is directed to antenna designs, and more particularly relates to a miniaturized folded slot-based antenna for use with Internet of Things (IoT) devices.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Sub gigahertz (GHz) networking supports frequency bands in the range of 868 MHz to 915 MHz. The aforementioned frequency band provides good capability to an antenna working in a long range and low power consumption scenario, and is therefore particularly well-suited for internet of things (IoT) related applications. In the past few years, growth of the $3^{rd}$ generation partnership project (3GPP) has started to focus on applications related to narrow band internet of things (NB-IoT) along with long-term evolution (LTE)-machine type communication (LTE-M). 3GPP complements the low power utilization of IoT devices with small and medium data transmission. Development of NB-IoT applications has facilitated use of a wide range of low power cellular services, whereas LTE-M applications have permitted reuse of the LTE networks and devices for IoT applications with higher data rate. High pace development and research in areas such as autonomous cars, smart cities, and intelligent devices have resulted in wireless communication infrastructures which support fast connectivity, low latency, and an extreme rate of data transfer. New wireless standards, such as 5th generation (5G) NB-IoT and LTE-M require the use of multi-band antenna designs with multi-standards coverages. Therefore, miniaturized frequency reconfigurable (FR) antennas with multiple connections with very wide sweep are highly desirable for 5G NB-IoT and LTE-M applications.

In order to support 5G-IoT and LTE-M applications, slot antennas have been developed to have compactness, low profile structure, and ability for wide sweep frequency reconfiguration (FR). FR based slot antennas have the potential to cover frequency bands of 2.3 GHz, 4.5 GHz and 5.8 GHz with a small circuit dimension of 27×25 $mm^2$. However, in order to achieve frequency reconfigurability, the conventional FR based slot antennas use multiple PIN diodes, which leads to high power consumption. Other FR based slot antennas have reduced circuit dimensions of 20×20 $mm^2$, and cover the frequency bands of 2.3-2.51 GHz and 4.95-5.53 GHz. Monopole antennas, on the other hand, are designed to support IoT applications which are capable of covering frequency bands of 1.79-2.63 GHz, 3.46-3.97 GHz, 4.92-5.58 GHz and 7.87-8.4 GHz and can have circuit dimensions of 20×30 $mm^2$. Other conventional slot antennas cover the frequency band of 3-12 GHz, and have reduced circuit dimensions of 9.45×18.5 $mm^2$. However, only a few frequency reconfigurable slot antennas operate in the sub-Ghz band and their frequency reconfigurability works only above 2 GHz.

U.S. Pat. No. 6,664,931B1 describes a slot antenna which operates in the sub-Ghz band, in which an open-ended slot antenna has a microstrip feed line and a U shaped conductive strip defining a conductive slot which forms the antenna on both sides of a substrate. The antenna operates in multi frequency bands wherein the upper band is 1.5-1.8 GHz, and the lower frequency band is 0.8-0.9 Ghz, and has a size of 33×10 $mm^2$. However, this slot antenna does not provide frequency reconfigurability in the sub-Ghz band.

US20130063313A1 describes an antenna having a meandering slot structure formed on either side of the substrate and wrapped around a metallic substrate. However, the operating frequency band of the antenna is above 2 GHz and the antenna is not capable of frequency reconfigurability in the sub-Ghz band.

Each of the aforementioned antenna designs suffer from one or more drawbacks hindering their adoption. For example, aforementioned antennas that operate in the sub-Ghz band are either elevated Printed Inverted F-Antennas (PIFA), monopoles or dipole antennas. The design of these antennas is a non-planer structure, they are not compact and do not provide frequency reconfigurability in sub-Ghz band. Those slot antennas which provide frequency reconfigurability in the sub-Ghz band have large antenna dimensions which hinder their adoption in practical scenarios. Moreover, the frequency tuning capability, large size and non-planer structure limit the utilization of such antennas in the sub-Ghz band, and cannot support small devices for the IoT applications.

Therefore, it is an object of the present disclosure to provide a highly compact slot antenna with frequency reconfigurability in the sub-Ghz band, which has a planar folded slot antenna structure.

SUMMARY

In an exemplary embodiment, a frequency reconfigurable miniaturized folded slot-based antenna for use with IoT devices is described herein. The frequency reconfigurable miniaturized folded slot-based antenna includes a circuit board having a front side and a back side separated by a dielectric layer. The front side includes a first metallic layer configured with a meandering slot having a first plurality of connected legs including at least a first leg, a center leg, and a last leg. The front side further includes a cutout in the first metallic layer. The front side further includes a variable reverse bias varactor diode connected across the center leg wherein the center leg is parallel to the cutout. The front side further includes an open-ended microstrip transmission line configured to receive a signal from a feed line. The front side also includes a first chock and a second choke. On the other hand, the back side of the frequency reconfigurable miniaturized folded slot-based antenna includes a second metallic layer configured to cover the back side and to connect with the first metallic layer at a first edge of the circuit board. The back side further includes a continuation of the meandering slot formed in the second metallic layer, wherein the second metallic layer includes a second plurality of connected legs. Also, a first leg and a last leg of the second plurality of connected legs is connected to the first leg and the last leg of the first plurality of connected legs at the first edge. The meandering slot of the antenna is configured to resonate at signal frequencies dependent on a setting of the variable reverse bias varactor diode.

In another exemplary embodiment, a method for forming a frequency reconfigurable miniaturized folded slot-based antenna is described. The method includes partially covering a front side of a dielectric circuit board with a metallic sheet. The method further includes wrapping the metallic sheet over a first edge of the dielectric circuit board to a back side of the dielectric circuit board. The method further includes completely covering the back side of the dielectric circuit board with the metallic sheet. The method further includes forming a meandering slot in the metallic sheet. The method further includes forming a cutout in the metallic sheet on the front side. The method further includes connecting a variable reverse bias varactor diode across a center leg of the meandering slot. The method further includes forming a metallic band on the front side of the dielectric circuit board, wherein the metallic band extends from a second edge to an axis, wherein the second edge and the axis are parallel to the first edge. The method further includes connecting a feed line to the metallic band at the second edge.

In another exemplary embodiment, a method of adjusting a resonance frequency of a frequency reconfigurable miniaturized folded slot-based antenna is described. The method includes applying a bias voltage to a first choke connected between a contact pad on a front side of a dielectric dielectric circuit board to a metallic sheet covering a back side of a dielectric circuit board, wherein the metallic sheet is wrapped around the back side to the front side, and partially covers the front side. The method further includes grounding a second choke connected between a ground connection and metallic sheet located on the front side. The method further includes applying a signal to a feed line connected to a metallic band located between an uncovered area of the front side and a cutout in the metallic sheet on the front side. The method further includes adjusting a capacitance of a variable reverse bias varactor diode located across a leg of a meandering slot formed in the metallic sheet.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
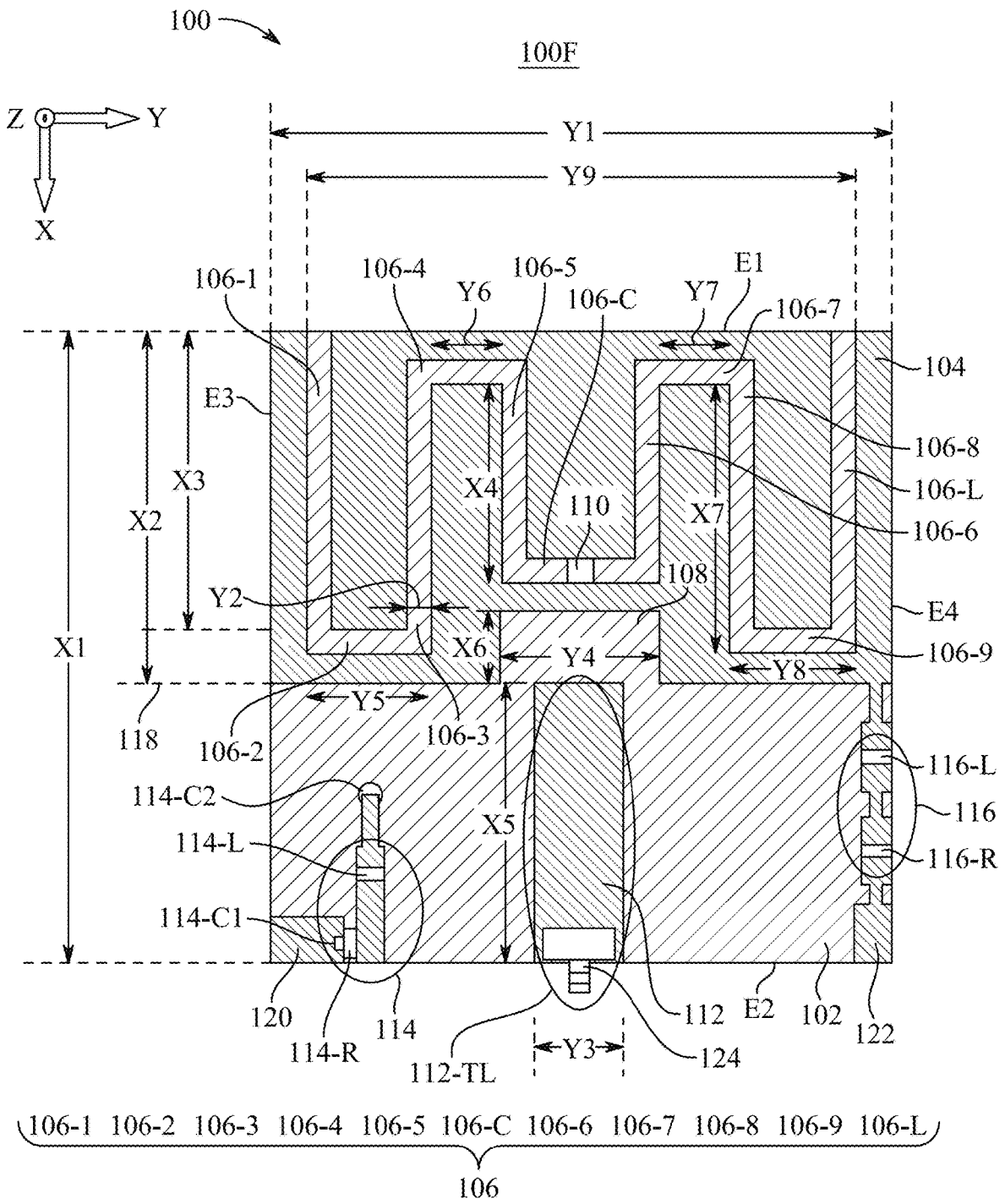
FIG. 1A illustrates a front side of a dielectric circuit board with a frequency reconfigurable miniaturized folded slot-based antenna, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

A meandering path is defined as a path which changes direction abruptly at points along the path.

Aspects of this disclosure are directed to a frequency reconfigurable miniaturized folded slot-based antenna for use with Internet of Things (IoT) devices, a method for forming a frequency reconfigurable miniaturized folded slot-based antenna, and a method of adjusting a resonance frequency of a frequency reconfigurable miniaturized folded slot-based antenna. The highly compact folded frequency reconfigurable miniaturized folded slot-based antenna is designed for use in 5G NB-IoT and LTE-M applications for sub-GHz operating bands. Unique features of the antenna are a planar structure, ease of fabrication, and reconfigurability of the frequency ranges with simple biasing circuitry using a varactor diode with a wide range frequency sweep. Miniaturization is achieved using a unique combination of reactively loaded folded-slot-line meandered structures.

The highly compact antenna dimensions of 27×27 $mm^2$ provide a smooth variation of resonating bands from 730~965 MHZ and 1250~1940 MHz. Although the antenna is described in the embodiments as having antenna dimension of 27×27 $mm^2$, the antenna may have dimensions smaller than 27×27 $mm^2$ with proportionally smaller leg lengths and widths.

Figure 1B:
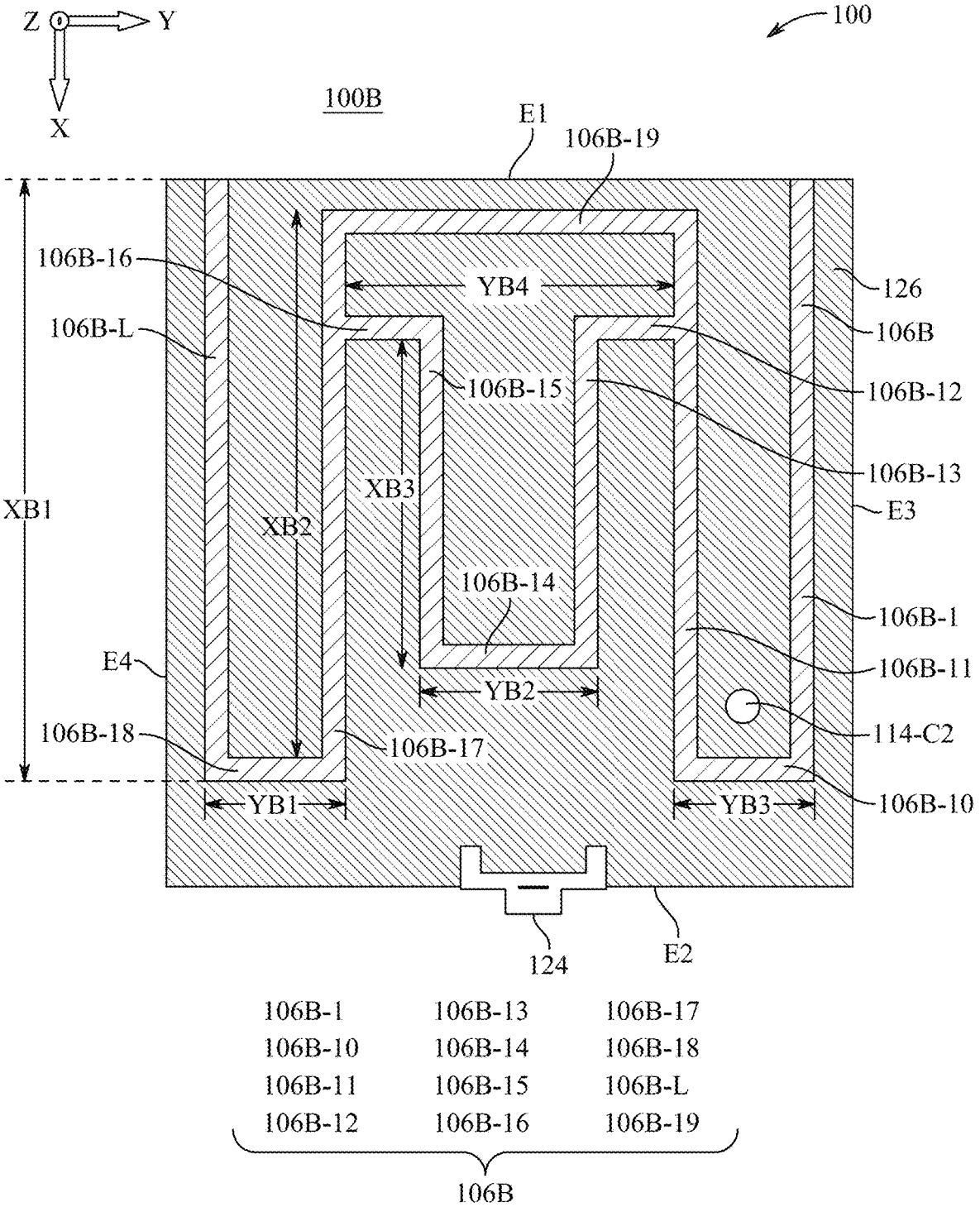
FIG. 1B illustrates a back side of the frequency reconfigurable miniaturized folded slot-based antenna, according to certain embodiments.

Accordingly, embodiments of the present disclosure relate to a frequency reconfigurable miniaturized folded slot-based antenna for use with internet of things (IoT) devices. As shown in FIG. 1A and FIG. 1B, the frequency reconfigurable miniaturized folded slot-based antenna includes a circuit board having a front side 100F and a back side 100B separated by a dielectric layer. The front side 100F includes a first metallic layer configured with a first microstrip slot having a first meandering path which continues around the edge E1 of a circuit board to the back side 100B. The first meandering path has a first plurality of connected legs. The front side 100F further includes a cutout in the first region at a center of the central axis. The front side 100F further includes a variable reverse bias varactor diode 110 connected across the first meandering path. The front side 100F further includes an open-ended microstrip transmission line configured to receive a signal from a feed line 124. The front side 100F further includes a first choke and a second choke. The back side 100B includes a second metallic layer configured to cover the back side 100B and connect with the first metallic layer and a second microstrip slot located in the second metallic layer. The second microstrip slot is configured in a second meandering path having a second plurality of connected legs, wherein a first leg and a last leg of the second plurality of connected legs is connected to the first leg and the last leg of the first plurality of connected legs. The first plurality of connected legs and the second plurality of connected legs are configured to resonate at signal frequencies dependent on settings of the variable reverse bias varactor diode. The details of the antenna design are illustrated in FIG. 1A and FIG. 1B.

FIG. 1A illustrates a front side 100F of a frequency reconfigurable miniaturized folded slot-based antenna 100 for use with Internet of Things (IoT) devices, according to an embodiment of the present disclosure. The frequency reconfigurable miniaturized folded slot-based antenna 100 (or simply referred to as antenna 100) comprises a circuit board 102 having the front side 100F and a back side 100B. The front side 100F may refer to a front view or top view of the antenna 100, and the back side 100B may refer to a bottom view of antenna 100. The back side 100B of the antenna 100 is described in detail in FIG. 1B. The front side 100F and the back side 100B of the circuit board 102 are separated by a dielectric material. In an example, the dielectric material may be selected from a group containing an FR-4 PCB, a PTFE material, or a Rogers RO4350 substrate of dielectric constant value equal to 3.48. The selection of the dielectric material is not limited to 3.48, and any other material known in the art may be selected to act as a base material for designing an electronic circuit of the frequency reconfigurable miniaturized folded slot-based antenna 100. In some examples, the thickness of the dielectric material may be selected in the range of 1.5 mm-4 mm. The slot width of the legs is 1 mm, which is optimal for best input matching with strong resonance frequency.

The circuit board 102 of the antenna 100 comprises at least four edges, that is, a first edge E1, a second edge E2, a third edge E3, and a fourth edge E4. The first edge E1 is parallel to the second edge E2, whereas the third edge E3 is parallel to the fourth edge E4. Also, the third edge E3 and the fourth edge E4 are perpendicular to the first edge E1 and the second edge E2. In an example, the width of the first edge E1 and the width of the second edge E2 is Y1 in the Y axis direction, which extends from E3 to E4. Similarly the length of the third edge E3 and the length of the fourth edge E4 is X1 in the X axis direction which extends from E1 to E2. The width Y1 and the length X1 are preferably 27 mm each. Accordingly, the width of the circuit board 102 parallel to the first edge E1 is less than or equal to 27 mm, and length of the circuit board 102 parallel to the third edge E3 is less than or equal to 27 mm. The area of the circuit board 102 and therefore the antenna 100 is less than or equal to 27×27 $mm^2$. However, the width Y1 and the length X1 may be smaller as needed to meet design specifications of antenna placement. For example, However, the width Y1 and the length X1 may each be selected from the range of 5 mm to 27 mm. Further, it can be contemplated that the width Y1 and the length X1 may be in the micron ranges if further miniaturization is needed.

The front side 100F of the antenna 100 includes a first metallic layer 104. In an example, the first metallic layer 104 may be selected from any one of copper, iron and aluminum. The first metallic layer 104 is configured with a meandering slot 106 having a first plurality of connected legs, including legs 106-1, 106-2, 106-3, 106-4, 106-5, 106-C, 106-6, 106-7, 106-8, 106-9 and 106-L. The meandering slot 106 refers to connected parallel and perpendicular empty portions or lines called slots of the first metallic layer 104. The empty portions or void portions are formed by etching out the first metallic layer 104 at a plurality of locations to form a slot structure in the first metallic layer 104. The etched-out void portion includes a plurality of such meandering slots 106, also referred to as legs, which are connected to one another in a continuous structure of the meandering slot 106. The plurality of legs are alternately connected to one another in parallel and perpendicular directions in the first metallic layer 104. Accordingly, the plurality of connected legs includes at least the first leg 106-1, the center leg 106-C and the last leg 106-L.

The plurality of connected legs of the meandering slot 106 comprises multiple such legs within the first metallic layer 104. For example, the first metallic layer 104 is etched out at plurality of locations in a continuous fashion to form the meandering slot 106 of antenna 100, such that the adjacent legs form the meandering slot path throughout the first metallic layer 104 in a first region denoted by an area X2×Y1. The first leg 106-1 extends from the first edge E1 and is parallel to the third edge E3. The first leg 106-4 also extends over the edge E1 to the back side, as will be discussed below. A second leg 106-2 is connected to and perpendicular to the first leg 106-1 and extends towards the fourth edge E4. A distance of the second leg 106-2 from the first edge E1 is X3. Also, the width of the second leg 106-2 is Y5. A third leg 106-3 is connected to the second leg 106-2 and is parallel to the first leg 106-1. A fourth leg 106-4 is connected to and perpendicular to the third leg 106-3 and extends towards the fourth edge E4. A width of the fourth leg 106-4 is Y6. A fifth leg 106-5 is connected to and parallel to the third leg 106-3 and extends towards the cutout 108. The cutout 108 is described later in the description. The center leg 106-C is connected to and perpendicular to the fifth leg 106-5 and extends towards the fourth edge E4. The center leg 106-C has the same width Y4 as the cutout 108. A distance between the center leg 106-C and the fourth leg 106-4 is X4. A sixth leg 106-6 is connected to and perpendicular to the center leg 106-C. The length of the sixth leg is also X4. A seventh leg 106-7 is connected to and perpendicular to the sixth leg 106-6 and extends towards the fourth edge E4. The width of the seventh leg 106-7 is Y7. Preferably, the width Y7 equals the width Y6. An eighth leg 106-8 is connected to and parallel to the sixth leg 106-6. The length of the eighth leg 106-8 is X7. Preferably, the length of leg 106-3 is also X7. A ninth leg 106-9 is connected to and perpendicular to the eighth leg 106-8 and extends towards the fourth edge E4. A width of the ninth leg 106-9 is Y8. Preferably, Y8 equals Y5. Also, a distance of the ninth leg 106-9 from the seventh leg 106-7 is X7. X7 also preferably equals the distance of the second leg 106-2 from the fourth leg 106-4. A Last leg 106-L is connected to parallel to the eighth leg 106-8 and extends to the first edge E1. The last leg 106-L further extends around the edge E1 to the back side. The length of the last leg 106-6 on the front side 100F equals the length X3. The path of the meandering slot 106 on the front side 100F includes 11 such legs. The thickness of each slot is the same and is equal to thickness Y2. In the example of the 27×27 $mm^2$ circuit board, X1 is equal to 27 mm, Y2 is equal to 1 mm, X3 is equal to 13.5 mm, X4 is equal to 11 mm, X7 is equal to 13 mm, Y4 is equal to 6.8 mm, Y5 is equal to 5.5 mm, and Y6 is equal to 3.5 mm.

The front side 100F includes the cutout 108 in the first metallic layer 104. A rectangular area of dimension X6×Y4 is etched out from the first metallic layer 104. Etching out the first metallic layer 104 of the rectangular area X6×Y4 thereby creates the cutout 108 exposing the dielectric material of the circuit board 102 of the antenna 100. Accordingly, the cutout 108 is located at a center of an imaginary central axis 118 extending between the third edge E3 and the fourth edge E4. The distance of the central axis 118 and the first edge E1 is X2. In an example, the distance X2 is equal to 15 mm. Also, the distance between a horizontal length Y4 of the cutout 108 and the central axis 118 is X6. In an example, the distance X6 is equal to 2.2 mm. The location of the cutout 108 is at the center of the length Y1. In some examples, the cutout 108 may include a rectangular shape. In some examples, the cutout 108 may include another shape, such as circular, triangular, hexagonal, pentagonal, etc. The center leg 106-C is parallel to the cutout 108. The width of the cutout 108 is Y4.

The front side 100F includes a variable reverse bias varactor diode 110 connected across the center leg 106-C of the meandering slot 106. In some examples, the variable reverse bias varactor diode 110 may be connected across the leg of the meandering slot 106 other than the central leg 106-C based on design requirements. In some examples, more than one variable reverse bias varactor diode 110 may be connected across multiple legs of the meandering slot 106 based upon a tuning range of the antenna 100 or based upon the application of the antenna 100. A capacitance of the variable reverse bias varactor diode 110 is configured to be adjustable in a range between 0.84 pF to 5.08 pF. In some examples, changing a voltage across the variable reverse bias varactor diode 110 changes the capacitance of the variable reverse bias varactor diode 110 in the range of 0.84 pF to 5.08 pF, preferably 1.0 pF to 4.0 pF, 2.0 pF to 3.0 pF or about 2.5 pF.

The front side 100F includes an open-ended microstrip transmission line 112-TL. The open-ended microstrip transmission line 112-TL includes a metallic band 112 and a feed line 124. The feed line 124 is utilized as a feeding point of an input signal that is to be radiated through the antenna 100. The open-ended microstrip transmission line 112-TL is configured to receive a signal from the feed line 124 thereof. The metallic band 112 extends from the second edge E2 to the imaginary central axis 118. The feed line 124 is connected to the metallic band 112 at the second edge E2. For example, in order to establish an electrical connection between the feed line 124 and the metallic band 112, the feed line 124 is electrically connected to the metallic band 112. In some examples, the metallic band 112 may be made up of any one of copper, iron and aluminum material. In some examples, the metallic band 112 may be made up of the same material as the first metallic layer 104. In some examples, length of the metallic band 112 is X5, and the width is Y3, respectively. In some examples, the length X5 is less than or equal to 12 mm. In some examples, the width Y3 is less than or equal to 4 mm or equal to 3.92 mm. Accordingly, the area of the metallic bond 112 is less than or equal to X5×Y3 units$^2$ or 48 $mm^2$. In some examples, the center leg 106-C and the cutout 108 have a first width that is equal to Y4 mm. The width Y3 of the metallic band 112 is smaller than the width Y4 of the cutout 108.

The front side 100F further includes a first metallic contact pad 120 located at a corner formed by the third edge E3 and the second edge E2. In an example, the first metallic contact pad 120 may have a dimension less than or equal to 1 $mm^2$ or 2 $mm^2$. The shape of the first metallic contact pad 120 may be rectangular, circular, triangular, etc. In some examples, the first metallic contact pad 120 may also be located at a position other than the corner formed by the third edge E3 and the second edge E2. For example, the first metallic contact pad 120 may be located at the third edge E3, without touching the border of the second edge E2. A bias voltage source (not shown) may be connected to the first metallic contact pad 120 to bias a first choke 114.

The front side 100F further includes the first choke 114. The first choke 114 is a combination of a first resistor 114-R of a first resistance value and a first inductor 114-L of a first inductance value. The first choke 114 further includes a first contactor 114-C1. One end of the first contactor 114-C1 is soldered to the first metallic contact pad 120 such that an electrical connection is established between the first metallic contact pad 120 and the first contactor 114-C1. The other end of the first contactor 114-C1 is electrically soldered to one of the end of the first resistor 114-R of the first choke 114, such that an electrical connection is also established between the first contactor 114-C1 and the first resistor 114-R. Also, the other end of the first resistor 114-R is electrically soldered to one of the end of the first inductor 114-L, such that an electrical connection is also established between the first resistance 114-R and the first inductor 114-L. The first choke 114 also includes a second contactor 114-C2 that is electrically connected to the other end or terminal of the first inductor 114-L, such that an electrical connection is also established between the first inductor 114-L and the second contactor 114-C2. The first metallic contact pad 120 is electrically coupled with a wire (not shown) to establish an electrical connection for biasing the antenna 100. A battery (not shown) having a positive voltage source is connected to the wire of the first metallic contact pad 122, such that a positive voltage is connected to the first metallic contact pad 120.

The front side 100F further includes a second metallic contact pad 122 located at a corner formed by the fourth edge E4 and the second edge E2. The second metallic contact pad 122 may have a dimension less than or equal to the range of 1 $mm^2$ to 2 $mm^2$. The shape of the second metallic contact pad 121 may also be rectangular, circular, triangular, etc. In some examples, the second metallic contact pad 122 may also be located at a position other than the corner formed by the fourth edge E4 and the second edge E2. For example, the second metallic contact pad 122 may be located at the fourth edge E4, without touching the second edge E2.

The front side 100F includes a second 116 choke. The second choke 116 includes a second resistor 116-R of a second resistance value and a second inductor 116-L of a second inductance value. One end of a second resistor 116-R is electrically connected to the second metallic contact pad 122 such that an electrical connection is established between the second metallic contact pad 122 and the second resistor 116-R of the second choke 116. Also, the other end of the second resister 116-R is electrically connected to one end of the second inductor 116-L, such that an electrical connection is also established between the second resistor 116-R and the second inductor 116-L. In an example, there may also be a metallic contact in between a bonding connection between the second resistor 116-R and the second inductance 116-L. The other end of the second inductance 116-L is electrically coupled to the first metallic layer 104, such that an electrical connection is also established between the second inductor 116-L and the first metallic layer 104. The second metallic contact pad 122 may be electrically coupled with a wire to establish an electrical connection. In some examples, the second choke 116 is connected between a ground line (not shown) at the second edge E2 and the first metallic layer 104. As such a ground connection or a zero reference voltage is applied to the second metallic contact pad 122 through the wire. For example, a battery having a zero side polarity may be electrically connected at the wire of the second metallic contact pad 122 for biasing the antenna 100.

FIG. 1B illustrates a back side 100B of the frequency reconfigurable miniaturized folded slot-based antenna 100, according to an embodiment of the present disclosure. The back side 100B refers to a back view or a bottom view of the antenna 100. The back side 100B of the antenna 100 includes a second metallic layer 126. The second metallic layer 126 is configured to cover the back side 100B of the dielectric circuit board 102 and to connect with the first metallic layer 104 at the first edge E1 of the dielectric circuit board 102. As such, the second metallic layer 126 is a continuation of the first metallic layer 104 which partially covers the front side 100F of the dielectric circuit board 102, whereas the second metallic layer 126 completely covers the back side 100B of the dielectric circuit board 102. As shown in FIG. 1D, the edge E1 is also covered by the metallic layer. In some examples, the first metallic layer 104 partially covers the front side 100F of the dielectric circuit board 102, folds at the first edge E1, and completely covers the back side 100B of the dielectric circuit board 102. Accordingly, the first metallic layer 104 and the second metallic layer 12 may refer to a single metallic layer configured to partially cover the front side 100F and fully cover the back side 100B of the dielectric circuit board 102.

Similar to the first plurality of connected legs formed in the first metallic layer 104, the second metallic layer 126 also includes a second plurality of connected legs, including at least continuation of first leg 106-1 to a first leg 106B-1 and a continuation of last leg 106-L to a last leg 106B-L. A meandering slot 106B at the back side 100B may refer to a void portion formed by etching out the second metallic layer 126 to form a slot structure in the second metallic layer 126. The etched-out void portion may include a plurality of legs of slot 106B, that are connected to one another in a continuous structure of the meandering slot 106B. The plurality of legs is connected to one another in parallel and perpendicular directions in the second metallic layer 126. Accordingly, a plurality of connected legs includes at least the first leg 106B-1 and the last leg 106B-L.

The plurality of connected legs of the meandering slot 106B includes multiple such legs within the second metallic layer 126. For example, the second metallic layer 126 is also etched out at a plurality of locations in a continuous fashion to form the meandered slot 106B of the antenna 100, such that the adjacent legs provide continuity of the slots throughout the second metallic layer 126. As such, the first leg 106B-1 extends from the first edge E1 as a continuation of leg 106-1 of the front side and is parallel to the third edge E3. A tenth leg 106B-10 is perpendicular and connected to the first leg 106-1 and extends towards the fourth edge E4. An eleventh leg 106B-11 is connected to 106B-10 and is parallel to the first leg 106B-1. A twelfth leg 106B-12 is connected to and perpendicular to the eleventh leg 106B-11 and extends towards the fourth edge E4. A thirteenth leg 106B-13 is connected to and perpendicular to leg 106B-12 and is parallel to the eleventh leg 106B-11. A fourteenth leg 106B-14 is perpendicular and connected to the thirteenth leg 106B-13 and extends towards the fourth edge E4. A fifteenth leg 106B-15 is connected to and perpendicular to leg 106B-14 and is parallel to the thirteenth leg 106B-13. A sixteenth leg 106B-16 is connected to and perpendicular to the fifteenth leg 106B-15 and extends towards the fourth edge E4. A seventeenth leg 106B-17 is connected to and perpendicular to the sixteenth leg 106B-16 and is parallel to the fifteenth leg 106B-15. An eighteenth leg 106B-18 is connected to and perpendicular to the seventeenth leg 106B-17 and extends towards the fourth edge E4. The last leg 106B-L is connected to and perpendicular to eighteenth leg 106B-18 and is parallel to the seventeenth leg 106B-17 and extends to the first edge E1. A nineteenth leg 106B-19 is connected between the eleventh leg 106B-11 and the seventeenth leg 106B-17. The first leg 106B-1 and the last leg 106B-L of the second plurality of connected legs are connected to the first leg 106-1, and the last leg 106-L of the first plurality of connected legs at the first edge E1. The meandering slot 106B, therefore, includes 12 such legs. The length of the first leg 106B-1 and the last leg 106B-L is XB1, the length of the eleventh leg 106B-11 and the seventeenth leg 106B-17 is XB2, and the length of thirteenth leg 106B-13 and the fifteenth leg 106B-15 is XB3. In one example implementation, a width of the eighteenth leg 106B-18 is YB1 or 5.5 mm, a width of the fourteenth leg 106B-14 is YB2 or 6.9 mm, width of the tenth leg 106B-10 is YB3 or 5.5 mm and a width of the nineteenth leg 106B-19 is YB4 or 13 mm. In some examples, the second metallic layer 126 is selected from any one of copper, iron and aluminum. In some examples, the second metallic layer 126 at the back side 100B of the antenna 100 is a continuation of the first metallic layer 104 at the front side 100F of the antenna 100 and accordingly, a continuation of the meandering slot 106B is formed in the second metallic layer 126 to increase the electrical length of the slot to operate at sub-1 GHz bands. The first metallic layer 104 is configured to partially cover the front side 100F of the antenna above the imaginary central axis 118. The first metallic layer 104 is folded at the first edge E1 such that the first metallic layer 104 wraps the dielectric circuit board 102 at the first edge E1. Also, the first metallic layer 104 covers the back side 100B of the dielectric circuit board 102. As such, the first metallic layer 104 covering the back side 100B of the dielectric circuit board 102 is also referred to as the second metallic layer 126. Moreover, a continuation of the etching process of the second metallic layer 126 is performed to increase the electrical length of the slot to operate at sub-1 GHz bands. Accordingly, as described earlier, the first leg 106B-1 and the last leg 106B-L of the second plurality of connected legs are connected to the first leg 106-1 and the last leg 106-L of the first plurality of connected legs at the first edge E1.

The back side 100B of the antenna 100 includes the second contactor 114-C2 of the first choke 114. The second contactor 114-C2 of the first choke 114 is connected through a via (not shown) of the dielectric circuit board 102 to the second metallic layer 126. The dielectric circuit board 102 may include a small hole (not shown) due to, for example, drilling the dielectric circuit board 102, thereby creating the via or a path (not shown). The via (not shown) provides an empty pathway for the second contactor 114-C2 to enter through the front side 100F, pass through the via and come out from the back side 100B, such that an electrical connection may be established between the first inductor 114-L of the first choke 114 on the front side 110F and the second metallic layer 126 on the back side 100B of the antenna 100. This is explained with an example. The other end of the first inductor 114L is electrically connected to a first terminal (not shown) of the second contactor 114-C2 to establish an electrical connection between the first inductor 114L and the second contactor 114-C2. A second terminal (not shown) of the second contactor 114-C2 is passed through the via (not shown) in the dielectric circuit board 102, such that the second terminal of the second contactor 114-C2 electrically contacts the second metallic layer 126 in order to establish the electrical connection between the first inductor 114-L of the first choke 114 and the second metallic layer 126. The second contactor 114-C2 is electrically connected to the surface of the second metallic layer 126, thereby providing mechanical strength to the electrical connection between the first choke 114 and the second metallic layer 126. In some examples, the second contactor 114-C2 of the first choke 114 is located between the eleventh leg 106B-11 and the first leg 106B-1, and within 2 mm millimeters of the tenth leg 106B-10. In some examples, the second contactor 114-C2 may be located above or below 2 mm of the tenth leg 106B-10 and is not restrictive. The via may be filled with a conductive material, such as electrically conducting solder.

Figure 1C:
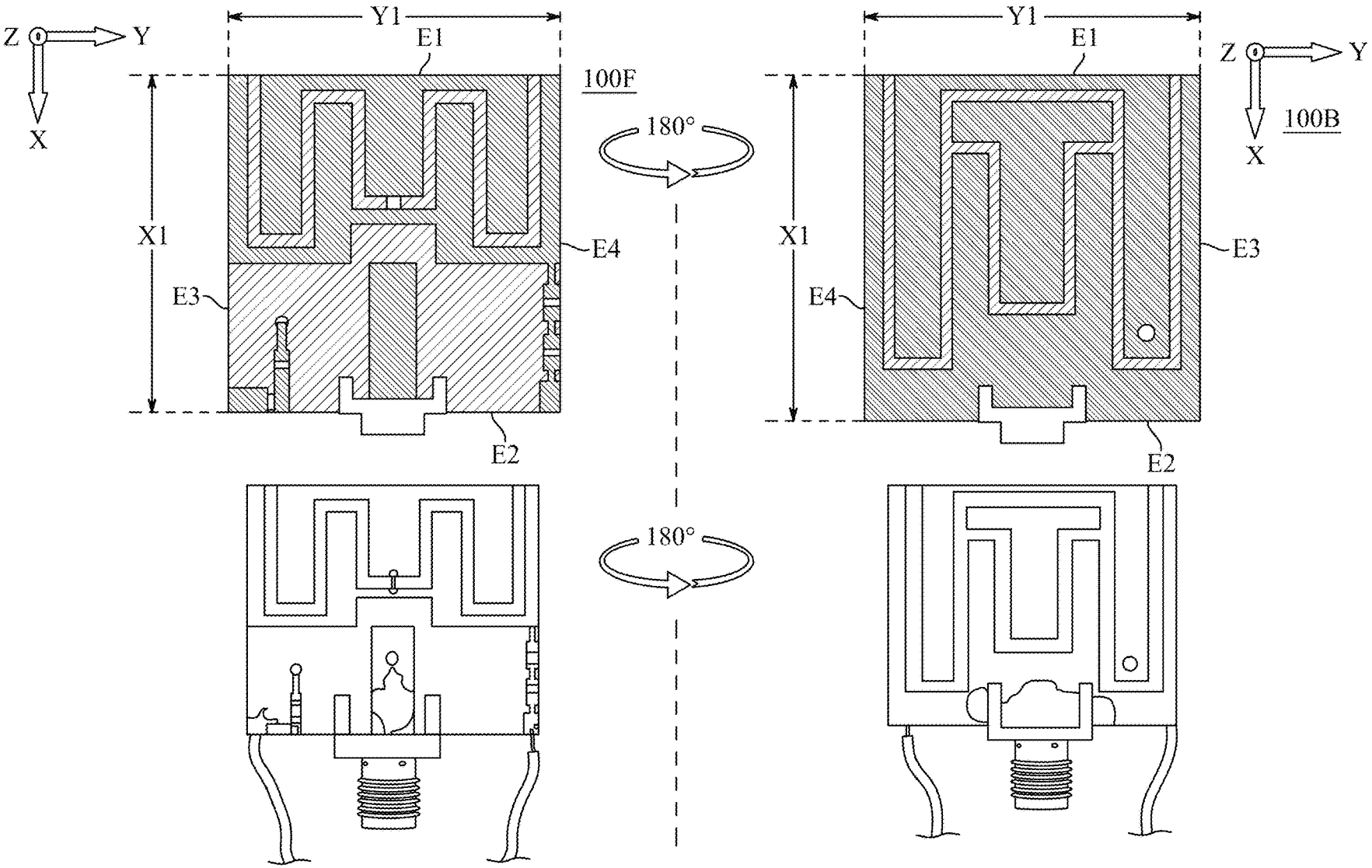
FIG. 1C illustrates a schematic diagram of a front side and a back side of the frequency reconfigurable miniaturized folded slot-based antenna, according to certain embodiments.
Figure 1D:
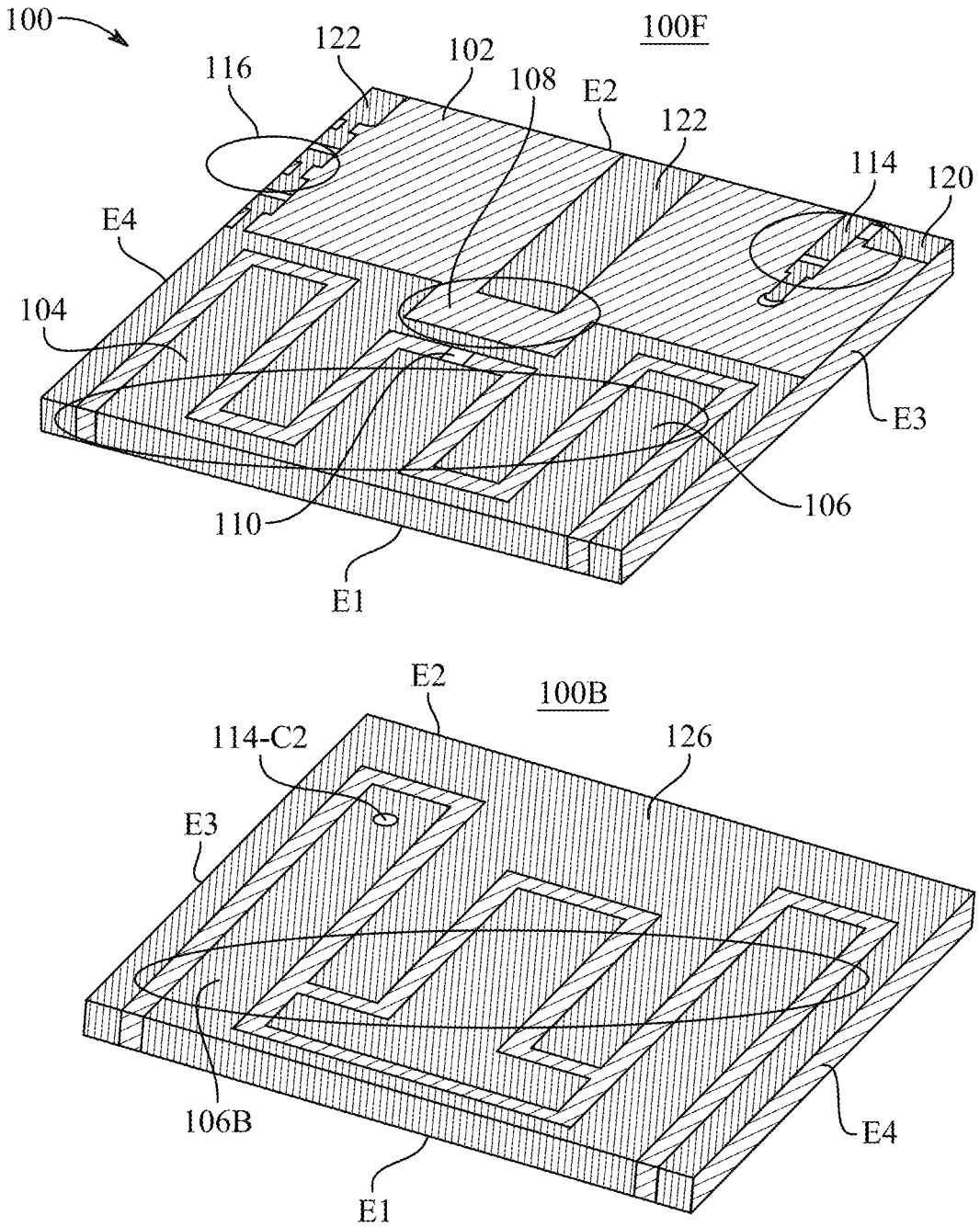
FIG. 1D illustrates a 3D view of the front side and back side of the frequency reconfigurable miniaturized folded slot-based antenna, according to certain embodiments.

FIG. 1C illustrates a schematic diagram of a front side 100F (left of FIG. 1C) and a back side 100B (right side of FIG. 1C) of the frequency reconfigurable miniaturized folded slot-based antenna 100, according to aspects of the present disclosure. The antenna 100 and all four edges, that is, the first edge E1, the second edge E2, the third edge E3, and the fourth edge E4, are illustrated in each diagram. A view of back side 100B is obtained when the front side 100F is rotated 180° with respect to the fourth edge E4. Additionally, a view of the back side 100B is also obtained when the front side 100F is rotated 180° with respect to the third edge E3. A practically implemented antenna 100 that resembles the schematic diagrams of the front and back side 100B of the antenna 100 is also illustrated below the schematic diagrams of the front and back side 100B of the antenna 100.

FIG. 1D illustrates a 3D view of the front side 100F and the back side 100B of the frequency reconfigurable miniaturized folded slot-based antenna 100, according to aspects of the present disclosure. The 3D view of the front and the back side 100B of the antenna 100 and the edges E1, E2, E3 and E4, respectively, are shown. The diagram also shows the location of the dielectric circuit board 102, the first metallic layer 104, the meandering slot 106, the cutout 108, the variable reverse bias varactor diode 110, the open-ended microstrip transmission line 112-TL, the first choke 114, the second choke 116, the first metallic contact pad 120, the second metallic contact pad 122, the second metallic layer 126 and the second contactor 114-C2. The meandering slot 106 on the first metallic layer 104 also passes over the first edge E1 as a continued portion of the meandering slot 106 from the first metallic layer 104 to the second metallic layer 126.

With reference to FIG. 1A, FIG. 1B, FIG. 1C and FIG. 1D, a method for forming a frequency reconfigurable miniaturized folded slot-based antenna 100, is described. To form the frequency reconfigurable miniaturized folded slot-based antenna 100, the front side 100F of the dielectric circuit board 102 is partially covered with a metallic sheet. For example, the first metallic layer 104 partially covers the dielectric circuit board 102 in the first region denoted by an area X2×Y1 units$^2$ above the imaginary central axis 118. The first metallic layer 104 is wrapped over the first edge E1 of the dielectric circuit board 102 to the back side 100B of the dielectric circuit board 102. The metallic sheet, that is, the first metallic layer 104 also referred to as a second metallic layer 126 on the back side 100B as a continuation of the first metallic layer 104 on the front side 100F and folded at the first edge E1, completely covers the back side 100B of the dielectric circuit board 102. In some examples, a second metallic layer 126 may completely cover the back side 100B of the dielectric circuit board 102 when the first metallic layer 104 only partially covers the front side 100F of the dielectric circuit board 102 and when the first metallic layer 104 and the second metallic layer 126 are different, the first metallic layer 104 contacts the second metallic layer 126 at the first edge E1. A meandering slot 106 is formed in the metallic sheets at a plurality of legs, that is, over the first metallic layer 104 and the second metallic layer 126 through, for example, an etching process or laser guided etching, such that the first metallic layer 104 at least includes the first leg 106-1, the center leg 106-C and the last leg 106-L. The meandering slot 106 includes a first plurality of connected legs on the front side 100F of the dielectric circuit board 102 as well as the second plurality of connected legs on the back side 100B of the dielectric circuit board 102. The first plurality of connected legs include a first leg 106-1 extending from the first edge E1 and parallel to the third edge E3, the second leg 106-2 perpendicular to the first leg 106-1 and extending towards a fourth edge E4 parallel to the third edge E3, the third leg 106-3 parallel to the first leg 106-1, the fourth leg 106-4 perpendicular to the third leg 106-3 and extending towards the fourth edge E4, the fifth leg 106-5 parallel to the third leg 106-3 and extending towards the cutout 108, the center leg 106-C perpendicular to the fifth leg 106-5 and parallel to the cutout 108 with the center leg 106-C extending towards the fourth edge E4, the sixth leg 106-6 parallel to the fifth leg 106-5, the seventh leg 106-7 perpendicular to the sixth leg 106-6 and extending towards the fourth edge E4, the eighth leg 106-8 parallel to the sixth leg 106-6, the ninth leg 106-9 perpendicular to the eighth leg 106-8 and extending towards the fourth edge E4, the last leg 106-L parallel to the eighth leg 106-8 and extending to the first edge E1. Similarly, the second plurality of connected legs include the first leg 106B-1 extending from the first edge E1 and parallel to the third edge E3, the tenth leg 106B-10 perpendicular to the first leg 106B-1 and extending towards the fourth edge E4, the eleventh leg 106B-11 parallel to the first leg 106B-1, the twelfth leg 106B-12 perpendicular to the eleventh leg 106B-11 and extending towards the fourth edge E4, the thirteenth leg 106B-13 parallel to the eleventh leg 106B-11, the fourteenth leg 106B-14 perpendicular to the thirteenth leg 106B-13 and extending towards the fourth edge E4, the fifteenth leg 106B-15 parallel to the thirteenth leg 106B-13, the sixteenth leg 106B-16 perpendicular to the fifteenth leg 106B-15 and extending towards the fourth edge E4, the seventeenth leg 106B-17 parallel to the fifteenth leg 106B-15, the eighteenth leg 106B-18 perpendicular to the seventeenth leg 106B-17 and extending towards the fourth edge E4, the last leg 106B-L parallel to the seventeenth leg 106B-17 and extending to the first edge E1 and the nineteenth leg 106B-19 connected between the eleventh leg 106B-11 and the seventeenth leg 106B-17.

The cutout 108 is formed in the metallic sheet, that is, the first metallic layer 104 on the front side 100F of the antenna 100 through, for example, the etching process. The metallic band 112 is formed on the front side 100F of the dielectric circuit board 102. The metallic band 112 extends from a second edge E2 to an imaginary central axis 118. The second edge E2 and the imaginary central axis 118 are parallel to the first edge E1. The feed line 124 is connected to the metallic band 112 at the second edge E2, for example, through soldering the feed line 124 to the metallic band 112. In some examples, the feed line 124 is also soldered to the second metallic layer 126 at the back side 100B of the dielectric circuit board 102.

A first choke 114 with resistance R1 and inductance L1 is connected between a positive voltage source, such as a battery, and the metallic sheet, that is, the second metallic layer 126 on the back side 100B of the antenna 100. A second choke 116 with resistance R2 and inductance L2 is connected between a ground voltage and the metallic sheet, that is, the first metallic layer 104 on the front side 100F of the antenna 100. As such, the first choke 114 and the second choke 116 are configured to bias the reconfigurable miniaturized folded slot-based antenna 100.

A metallic contact pad, for example, the first metallic contact pad 120, is formed at a corner formed by the second edge E2 and the third edge E3 perpendicular to the second edge E2. The positive voltage source is applied to the metallic contact pad, that is, the first metallic contact pad 120. A first contactor 114-C1 of the first choke 114 of the plurality of chokes is connected to the metallic contact pad, that is, the first metallic contact pad 120. A second contactor 114-C2 of the first choke 114 is connected through a via in the dielectric circuit board 102 to the metallic sheet, that is, the second metallic layer 126 on the back side 100B of the antenna 100. Similarly, the second choke 116 of the plurality of chokes is connected between the ground line located at the second edge E2 and the metallic sheet, that is, the first metallic layer 104 on the front side 100F of the antenna 100.

With reference to FIG. 1A, FIG. 1B, FIG. 1C and FIG. 1D, a method of adjusting a resonance frequency of the frequency reconfigurable miniaturized folded slot-based antenna 100 is described. A bias voltage such as a positive terminal of the battery is applied to the first choke 114 that is connected between a contact pad, that is, the first metallic contact pad 120 on a front side 100F of the dielectric circuit board 102 to the metallic sheet, that is, the second metallic layer 126 that covers the back side 100B of a dielectric circuit board 102. The metallic sheet, that is, the first metallic layer 104, partially covers the front side 100F of the antenna 100 up to the imaginary central axis 118 and fully covers the back side 100B of the antenna 100. As such, the first metallic layer 104 is folded at the first edge E1 and wrapped to the back side 100B of the dielectric circuit board 102. Similarly, the second choke 116 is connected between a ground connection of the battery and metallic sheet, that is, the first metallic layer 104 is located on the front side 100F of the antenna 100. Accordingly, a positive voltage source is applied at the first metallic contact pad 120, and ground or zero voltage is applied at the second metallic contact pad 122 in order to bias the first choke 114 and the second choke 116. Biasing the first choke 114 with a positive voltage biases an area covered within or an upper region bordered by the first leg 106-1, the second leg 106-2, the third leg 106-3, the fourth leg 106-4, the fifth leg 105-5, the central leg 106-C, the sixth leg 106-6, the seventh leg 106-7, the eighth leg 106-8, the ninth leg 106-9 and the last leg 106-L in the first metallic layer 104 as well as the first leg 106B-1, the tenth leg 106B-10, the eleventh leg 106B-11, the nineteenth leg 106B-19, the seventeenth leg 106B-17, the eighteenth leg 106B-18 and the last leg 106B-L in the second metallic layer 126. Similarly, biasing the second choke 116 with a ground voltage biases an area covered outside or a lower region bordered by the first leg 106-1, the second leg 106-2, the third leg 106-3, the fourth leg 106-4, the fifth leg 105-5, the central leg 106-C, the sixth leg 106-6, the seventh leg 106-7, the eighth leg 106-8, the ninth leg 106-9 and the last leg 106-L in the first metallic layer 104 as well as the first leg 106B-1, the tenth leg 106B-10, the eleventh leg 106B-11, the nineteenth leg 106B-19, the seventeenth leg 106B-17, the eighteenth leg 106B-18 and the last leg 106B-L in the second metallic layer 126. The arrangement of the input voltage at the first choke 114 and the ground voltage at the second choke 116 therefore biases the variable reverse bias varactor diode 110.

A signal that is to be radiated is applied to the feed line 124 is electrically connected to the metallic band 112 located between an uncovered area of dimension X5×Y3 of the front side 100F and the cutout 108 in the metallic sheet, that is, the first metallic layer 104 on the front side 100F of the antenna 100. The meandering slot 106 on the first metallic layer 104 and the meandering slot 106B on the second metallic layer 126 resonate at signal frequencies dependent on a setting of the variable reverse bias varactor diode 110.

A capacitance of the variable reverse bias varactor diode 110 is located across the leg, that is, the central leg 106-C of the meandering slot formed in the metallic sheet, that is, the first metallic layer 104 is adjusted to adjust the resonance frequency of the frequency reconfigurable miniaturized folded slot-based antenna 100. For example, when the capacitance of the variable reverse bias varactor diode 110 is adjusted in a range between 0.84 pF to 5.08 pF using the biasing voltage applied at the first metallic contact pad 120, and the second metallic contact pad 122, the capacitance changes. Changing the capacitance of the variable reverse bias varactor diode 110 also changes the resonance frequency of the meandering slots available on both sides of the antenna 100. Therefore, adjusting the range of the capacitor or the capacitance of the variable reverse bias varactor diode 110 changes the resonance frequency of the antenna 100. In some examples, the meandering slots on the first metallic layer 104 and the second metallic layer 126 of the antenna 100 are configured to radiate in dual frequency bands. For example, the first frequency band lies in a range of 730 MHz to 965 MHz and a second frequency band lies in a range of 1250 MHz to 1940 MHz. Changing the capacitance value of the variable reverse bias varactor diode 110 also switches the operating frequency band of the antenna 100. As such, due to biasing voltage, the capacitance value of the variable reverse bias varactor diode 110, for example, from 0.84 pF to 3 pF, the antenna 100 works in the 730 MHz to 965 MHz. When the biasing voltage is changed, the capacitance value of the variable reverse bias varactor diode 110 lies in the range, for example, from 3 pF to 5.08 pF, the antenna 100 works in the 1250 MHz to 1940 MHz. As such, the antenna 100 is capable of being tuned from 730~965 MHZ and 1250~1940 MHz for the first and second resonating bands, respectively. Switching between the bands is obtained merely by varying the capacitance values of the variable reverse bias varactor diode 110. The dual-band operation with wide frequency sweep permits the highly compact antenna 100 having an area of the dielectric circuit board 102 less than or equal to 27×27 $mm^2$ to be utilized in NB-IoT and LTE-M applications. Also, frequency reconfigurability is achieved by varying the reverse-biased voltage across the varactor diode 110. In some examples, the biasing circuit included as the first choke 114 and the second choke 116 has the inductance value of 10 nH to isolate RF signal from DC. Also, both resistors, that is, R1 and R2 of the first choke 114 and the second choke 116 have values in the range of 2.1 KΩ limit the RF signal at low frequencies where inductance is small.

Figure 2A:
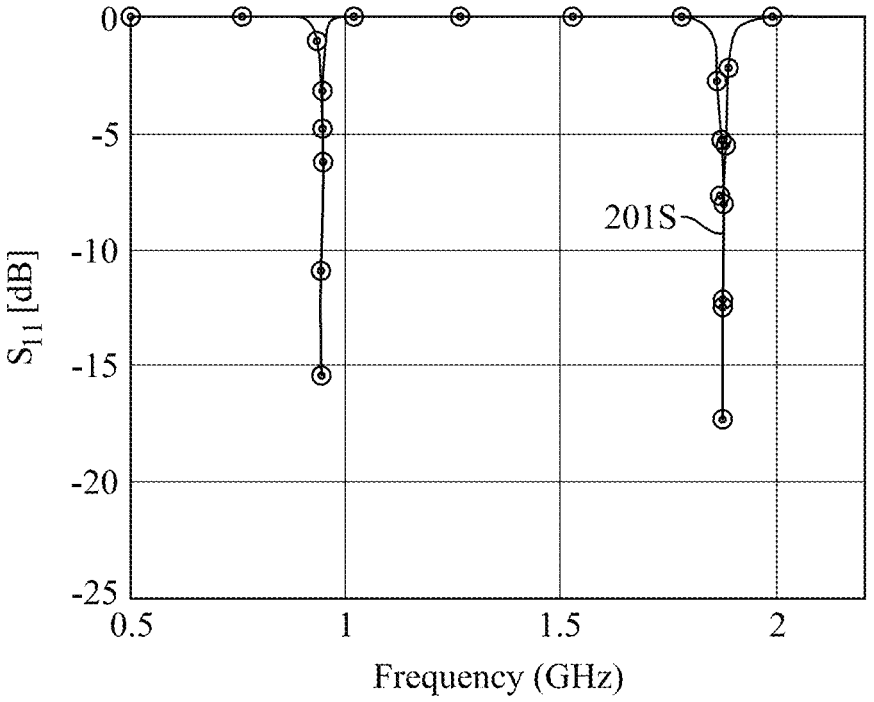
FIG. 2A illustrates a graph of a simulated reflection coefficient $S_{11}$ at a varactor capacitance of C=0.84 pF, according to certain embodiments.

FIG. 2A illustrates a curve 201S for a simulated reflection coefficient $S_{11}$ of the frequency reconfigurable miniaturized folded slot-based antenna 100 at the varactor capacitance of C=0.84 pF, for a frequency range of 0.5 GHz to 2 GHz. $S_{11}$ denotes the amount of input power reflected from the antenna 100 when a signal is applied at the input port, i.e., at the feed line 124 of the open-ended microstrip transmission line 112-TL. The reflection coefficient is also known as a return loss of the antenna 100. In an example, if $S_{11}$=0 dB then all the power is reflected from the antenna 100, and nothing is radiated. To examine the performance of the antenna 100, the antenna 100 was simulated using a high-frequency structure simulator (HFSS) (By Ansys, Canonsburg, Pa.). The elements of the biasing circuit, such as the first resistor 114-R and the first inductor 114-L of the first choke 114, as well as the second resistor 116-R and the second inductor 116-L of the second choke 116, along with the varactor diode 110 were modeled as lumped elements. The capacitance of the reverse-biased varactor diode 110 can be varied from 0.84 pF to 5.08 pF.

Figure 2B:
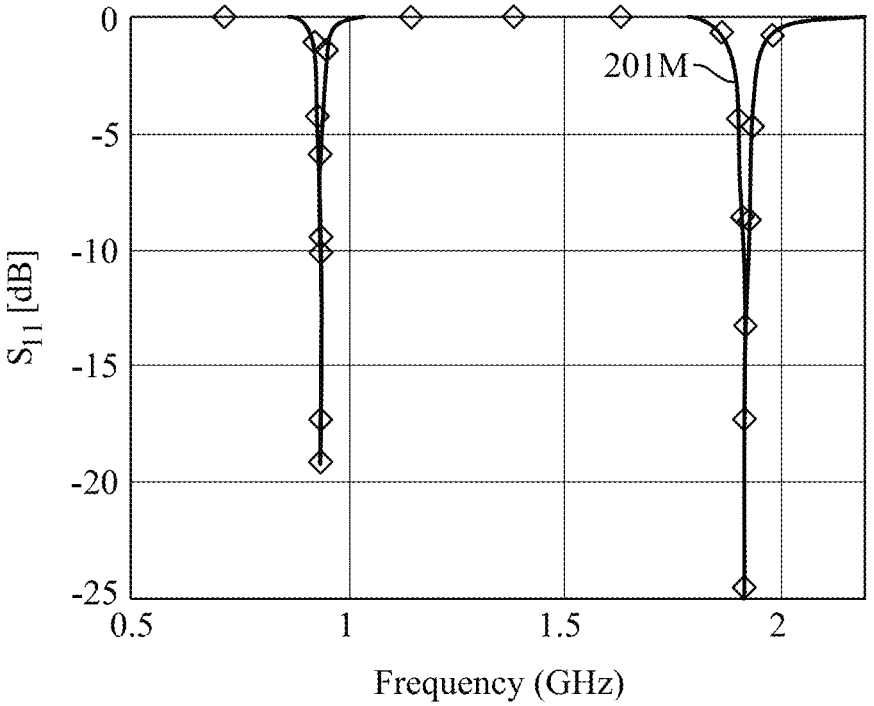
FIG. 2B illustrates a graph of a measured reflection coefficient $S_{11}$ at the varactor capacitance of C=0.84 pF, according to certain embodiments.

FIG. 2B is a graph of a curve 201M for a measured reflection coefficient $S_{11}$ of the antenna 100 at the varactor capacitance of C=0.84 pF for a frequency range of 0.5 GHz to 2 GHz.

Figure 3A:
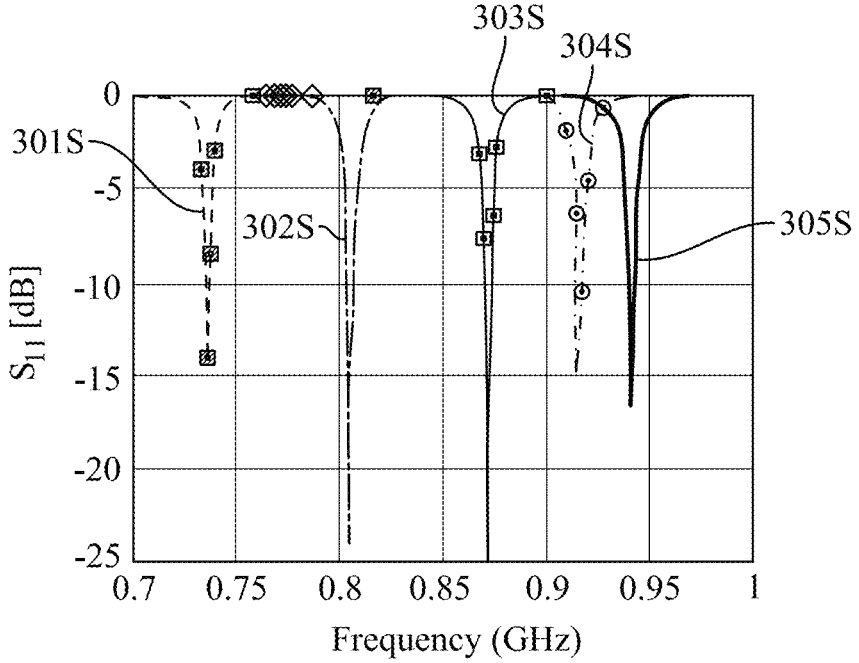
FIG. 3A is a graph of the simulated reflection coefficient $S_{11}$ in the sub-GHz frequency bands, according to certain embodiments.

FIG. 3A illustrates plurality of curves for a simulated reflection coefficient $S_{11}$ at a sub GHz band. A curve 301S, a curve 302, a curve 303, a curve 304, and a curve 305 were obtained when the capacitance value of the reverse bias varactor diode 110 was set values of 5.08 pF, 2.09 pF, 1.24 pF 0.09 pF, and 0.84 pF, respectively. The curves collectively illustrate the characteristics of the antenna 100 in a resonance frequency band from 730~965 MHz. Optimum reflection coefficients $S_{11}$ were obtained by varying the capacitance values of the reverse bias varactor diode 110.

Figure 3B:
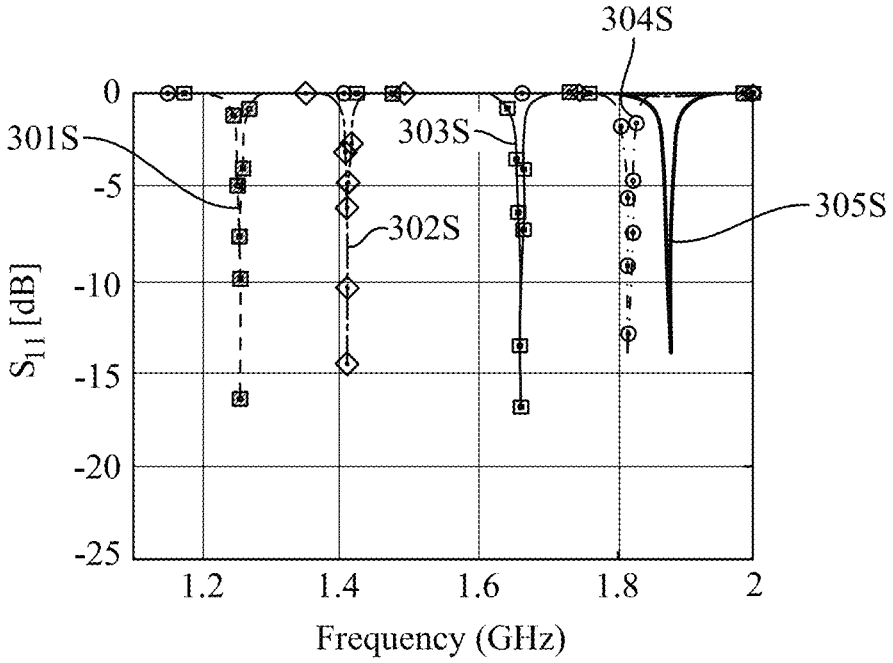
FIG. 3B is a graph of the simulated reflection coefficient $S_{11}$ in the frequency range of 1.2-2 GHz, according to certain embodiments.

FIG. 3B illustrates a plurality of curves for a simulated reflection coefficient $S_{11}$ in the upper band of 1.2 to 2 GHz. A curve 301S, a curve 302, a curve 303, a curve 304, and a curve 305 were obtained when a capacitance value of the reverse bias varactor diode 110 was adjusted to values of 5.08 pF, 2.09 pF, 1.24 pF 0.09 pF, and 0.84 pF, respectively. The curves collectively illustrate the characteristics of the antenna 100 of the present disclosure in a higher resonance frequency band from 1250~1940 MHz. Optimum reflection coefficients $S_{11}$ were obtained by varying the capacitance values of the reverse bias varactor diode 110.

Figure 3C:
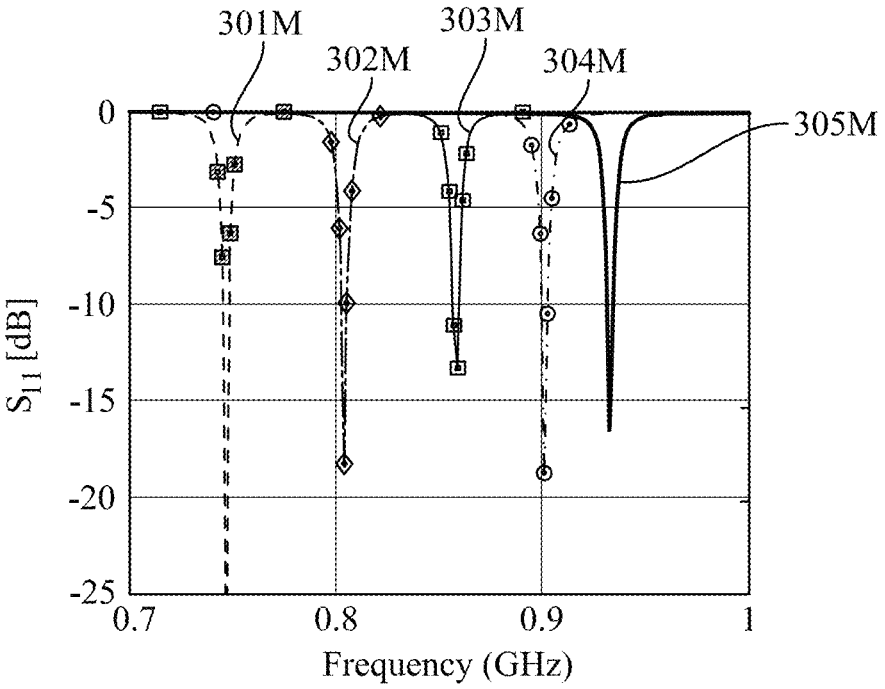
FIG. 3C is a graph of the measured reflection coefficient $S_{11}$ in the frequency range of 1.2-2 GHz, according to certain embodiments.

FIG. 3C illustrates plurality of curves for a measured reflection coefficient $S_{11}$ at the lower sub GHz band, according to an aspect of the present disclosure. The curves collectively illustrate the characteristics of the antenna 100 in a resonance frequency band from 730-965 MHz. A curve 301M, a curve 302M, a curve 303M, a curve 304M and a curve 305M were obtained when the reverse bias voltage of the reverse bias varactor diode 110 was adjusted to values of 0V, 2.5V, 5V, 10V and 15V, respectively.

Figure 3D:
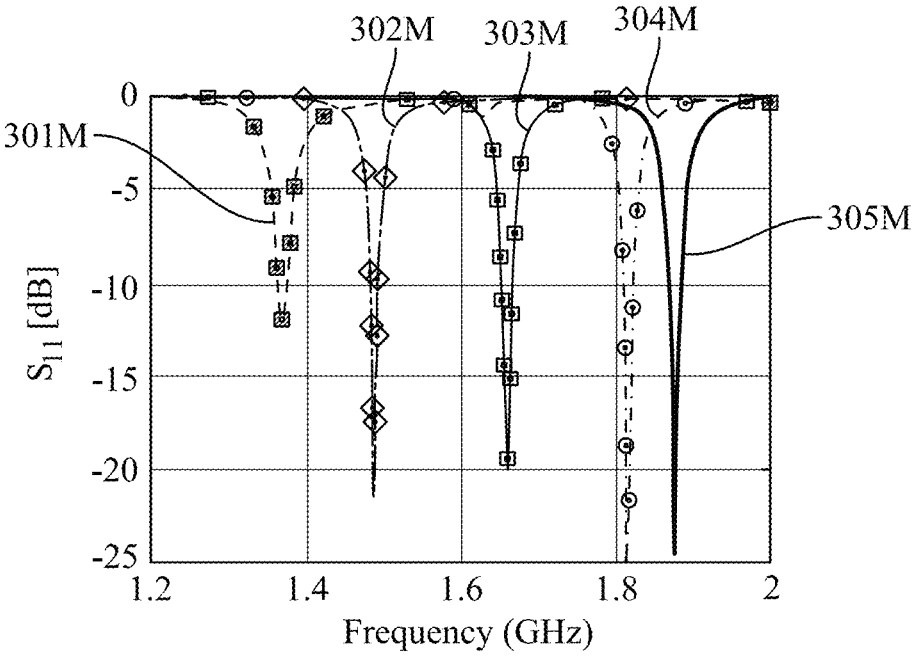
FIG. 3D is a graph of the measured reflection coefficient $S_{11}$ in the frequency range of 1.2-2 GHz, according to certain embodiments.

FIG. 3D illustrates a measured reflection coefficient $S_{11}$ in the upper band extending from 1.2 GHz to 2 GHz, according to an aspect of the present disclosure. A curve 301M, a curve 302M, a curve 303M, a curve 304M and a curve 305M were obtained when the reverse bias voltage of the reverse bias varactor diode 110 was adjusted at 0V, 2.5V, 5V, 10V and 15V, respectively. The curves collectively illustrate the characteristics of the antenna 100 in a resonance frequency band from 1.2 GHz to 2 GHz.

Based upon the characteristics of the reflection coefficients $S_{11}$ of the antenna design 100 in various bands as illustrated in graphs in FIG. 3A, FIGS. 3B, 3C, and 3D, the dual-band operation with wide frequency sweep permits the design of the antenna 100 to be utilized in NB-IoT as well as the LTE-M applications.

Figures 4A, 4B:
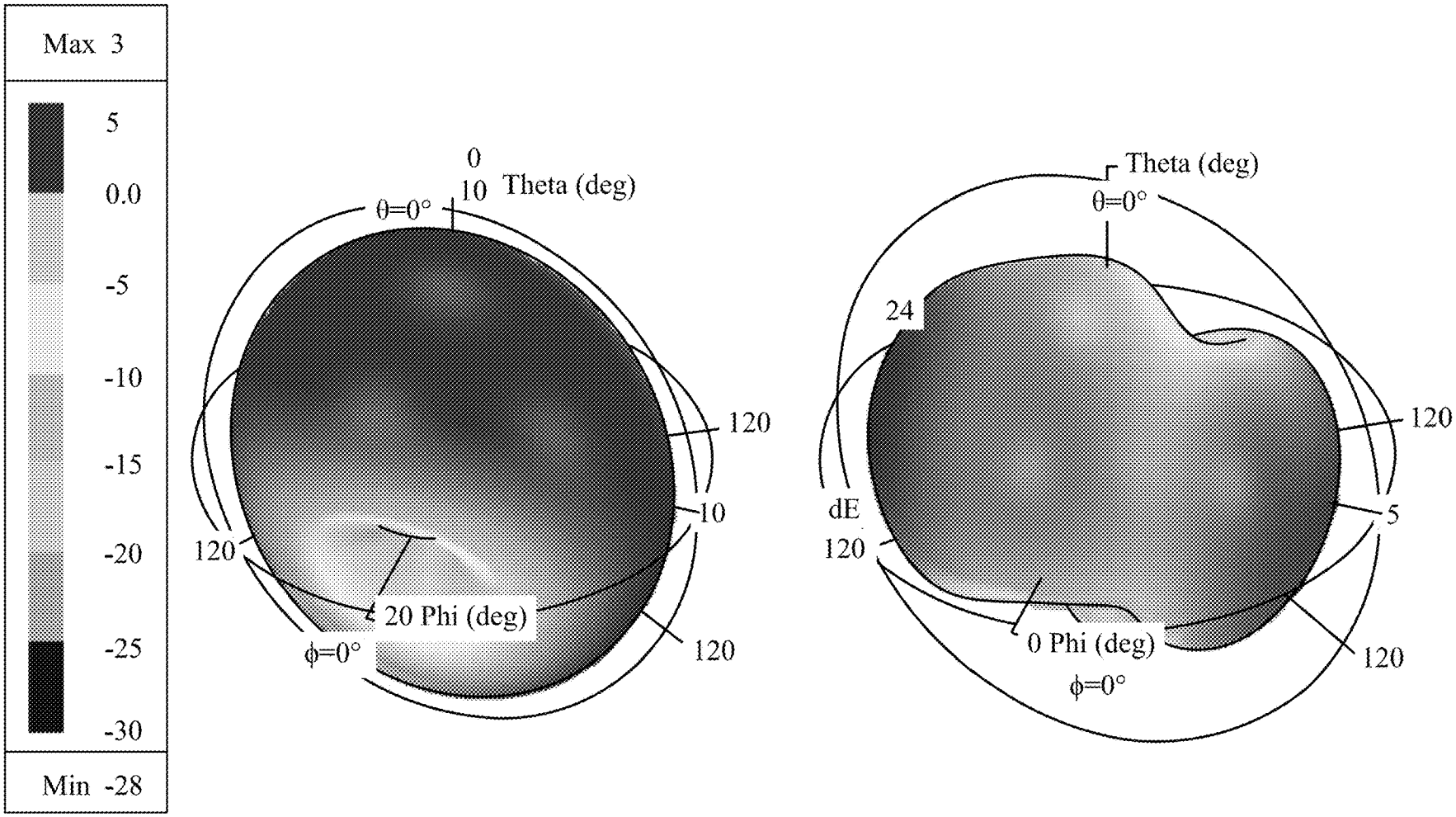
FIG. 4A illustrates a gain pattern of the antenna at 946 MHz, according to certain embodiments.
FIG. 4B illustrates a gain pattern of the antenna at 1876 MHz, according to certain embodiments.

FIG. 4A illustrates a gain pattern of the antenna design 100 at 946 MHz, according to an aspect of the present disclosure. The gain pattern with peak gain values of 0.56 dB is experimentally obtained at 946 MHz.

FIG. 4B illustrates a gain pattern of the antenna design at 1876 MHz, according to an aspect of the present disclosure. The gain pattern with peak gain values of 2.1 dB is experimentally obtained at 1876 MHz.

Figure 5:
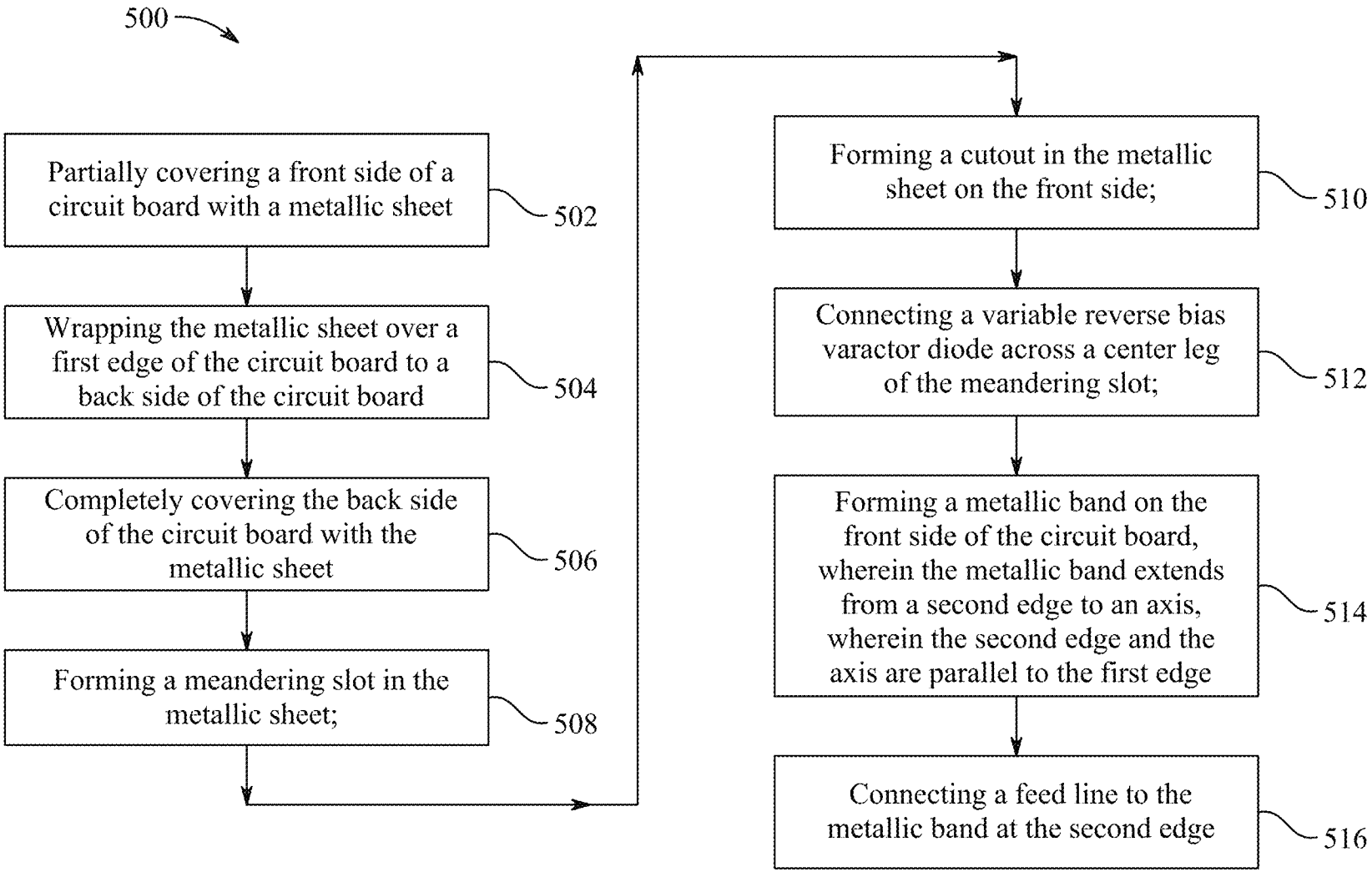
FIG. 5 is a flowchart of a method of forming a frequency reconfigurable miniaturized folded slot-based antenna, according to certain embodiments.

FIG. 5 illustrates a flowchart of a method 500 of forming a frequency reconfigurable miniaturized folded slot-based antenna 100, according to an embodiment of the present disclosure. The method 500 is described in conjunction with figures FIGS. 1A, 1B, 1C and 1D. Various steps of the method 500 are included through blocks in FIG. 5. One or more blocks may be combined or eliminated to form or achieve the frequency reconfigurable miniaturized folded slot-based antenna 100 without departing from the scope of the present disclosure.

At step 502, the method 500 includes partially covering a front side 100F of a dielectric circuit board 102 with a metallic sheet. For example, the front side 100F of the dielectric circuit board 102 is covered by the first metallic layer 104.

At step 504, the method 500 includes wrapping the metallic sheet over the first edge E1 of the dielectric circuit board 102 to a back side 100B of the dielectric circuit board 102. As such, the first metallic layer 104 also wraps the over the first edge E1 of the dielectric circuit board 102 and carrying the first metallic layer 104 to the back side 100B of the dielectric circuit board 102.

At step 506, the method 500 includes completely covering the back side 100B of the dielectric circuit board 102 with the metallic sheet. For example, the first metallic layer 104 also covers the back side 100B of the dielectric circuit board 102. In some examples, a separate metallic sheet such as a second metallic layer 126 may completely cover the back side 100B of the dielectric circuit board 102 and wherein the first metallic layer 104 only partially covers the front side 100F of the dielectric circuit board 102 and wherein the first metallic layer 104 and the second metallic layer 126 contacts at the first edge E1 of the dielectric circuit board 102.

At step 508, the method 500 includes forming a meandering slot 106 in the metallic sheet. As such plurality of meandering slots comprising the legs are formed by etching out the first metallic layer 104 at the front side 100F and the second metallic layer 126 on the back side 100B, respectively. Also, the first leg 106-1 of the front side 100F connects the first leg 106B-1 on the back side 100B. Similarly, the last leg 106-L of the front side 100F connects the last leg 106B-L on the back side 100B. Accordingly, the electrical length of the slot is increased.

At step 510, the method 500 includes forming the cutout 108 in the metallic sheet on the front side 100F, that is, the over the first metallic layer 104. The cutout 108 is formed in the area covered by X6×Y4 $mm^2$.

At step 512, the method 500 includes connecting a variable reverse bias varactor diode 110 across the center leg 106-C of the meandering slot over the front side 100F.

At step 514, the method 500 includes forming the metallic band 112 on the front side 100F of the dielectric circuit board 102. The metallic band 112 extends from the second edge E2 to the imaginary central axis 118. The second edge E2 and the imaginary central axis 118 are parallel to the first edge E1.

At step 516, the method 500 includes connecting the feed line 124 to the metallic band 112 at the second edge E2.

Figure 6:
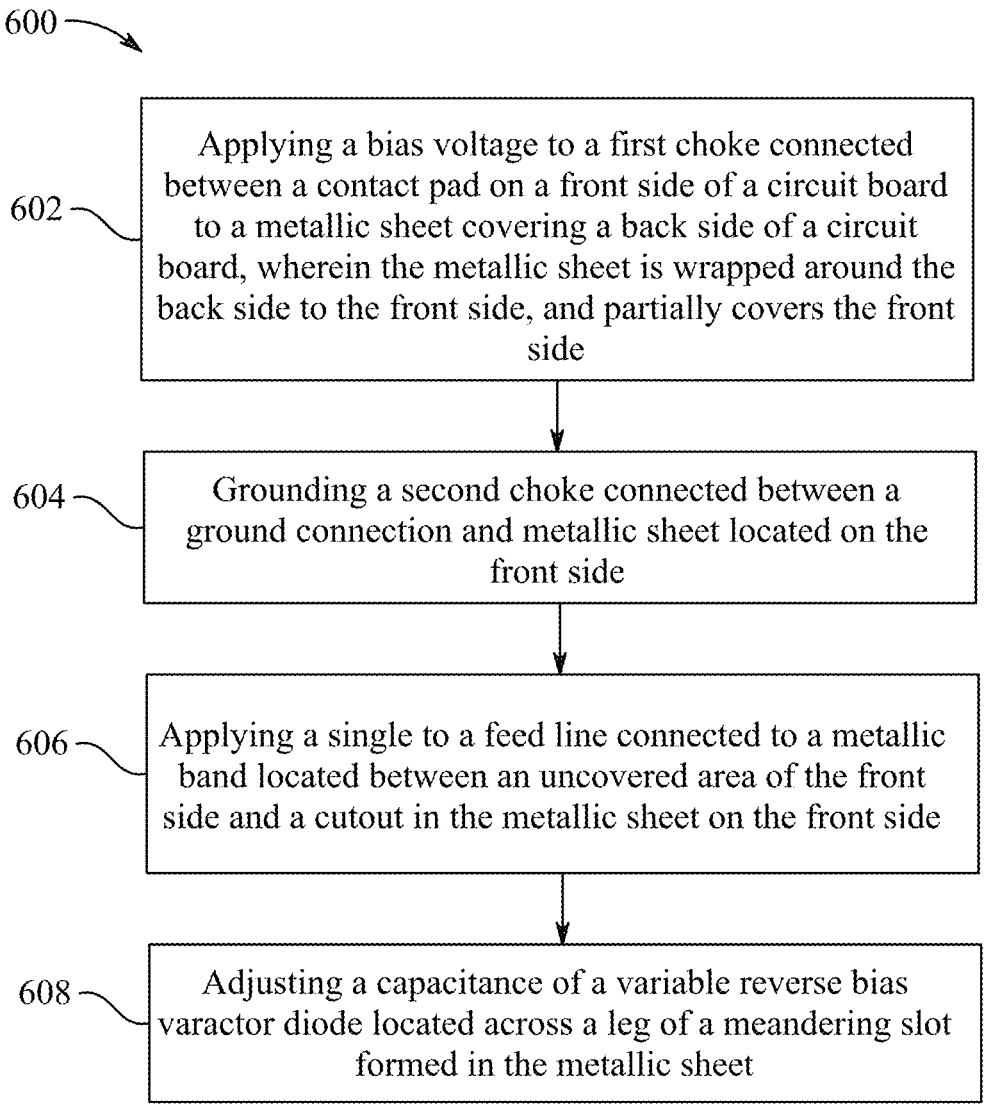
FIG. 6 is a flowchart of a method of adjusting a resonance frequency of a frequency reconfigurable miniaturized folded slot-based antenna, according to certain embodiments.

FIG. 6 illustrates a flowchart of a method 600 of adjusting a resonance frequency of a frequency reconfigurable miniaturized folded slot-based antenna 100, according to aspects of the present disclosure. The method 600 is described in conjunction with figures FIGS. 1A, 1B, 1C and 1D. Various steps of the method 600 are included through blocks in FIG. 6. One or more blocks may be combined or eliminated to adjust the resonance frequency of the frequency reconfigurable miniaturized folded slot-based antenna 100 without departing from the scope of the present disclosure.

At step 602, the method 600 includes applying a bias voltage to a first choke 114 connected between a first contact pad 120 on a front side 100F of a dielectric circuit board 102 to a metallic sheet, that is, the second metallic sheet 126 covering a back side 100B of a dielectric circuit board 102. The metallic sheet, that is, the second metallic layer 126 is wrapped around the back side 100B to the front side 100F, and partially covers the front side 100F.

At step 604, the method 600 includes grounding a second choke 116 connected between a ground connection and the metallic sheet, that is, the first metallic layer 104 located on the front side 100F.

At step 606, the method 600 includes applying a signal to a feed line 124 connected to a metallic band 112 located between an uncovered area of dimension X5×Y3 $mm^2$ of the front side 100F and a cutout 108 in the metallic sheet, that is, the first metallic layer 104 on the front side 100F.

At step 608, the method 600 includes adjusting a capacitance of a variable reverse bias varactor diode 110 located across the central leg 106-C of a meandering slot 106 formed in the first metallic layer 104.

The first embodiment is illustrated with respect to FIGS. 1A-1D. The first embodiment describes a frequency reconfigurable miniaturized folded slot-based antenna 100 for use with Internet of Things (IoT) devices. The frequency reconfigurable miniaturized folded slot-based antenna 100 includes a dielectric circuit board 102 having a front side 100F and a back side 100B separated by a dielectric. The front side 100F includes a first metallic layer 104 configured with a meandering slot 106 having a first plurality of connected legs including at least a first leg 106-1, a center leg 106-C, and a last leg 106-L; a cutout 108 in the first metallic layer 104; a variable reverse bias varactor diode 110 connected across the center leg 106-C, wherein the center leg 106-C is parallel to the cutout 108; an open-ended microstrip transmission line 112-TL configured to receive a signal from a feed line 124; a first choke 114 and a second choke 116.

The back side 100B includes a second metallic layer configured to cover the back side 100B and to connect with the first metallic layer 126 at a first edge E1 of the dielectric circuit board 102; a continuation of the meandering slot 106B formed in the second metallic layer 126, wherein the second metallic layer 126 includes a second plurality of connected legs, wherein a first leg 106B-1 and a last leg 106B-L of the second plurality of connected legs is connected to the first leg 106-1 and the last leg 106-L of the first plurality of connected legs at the first edge E1; and wherein the meandering slot 106 and 106B is configured to resonate at signal frequencies dependent on a setting of the variable reverse bias varactor diode 110.

In an aspect, the dielectric circuit board 102 includes a second edge E2 parallel to the first edge E1; a third edge E3 parallel to a fourth edge E4, wherein the third edge E3 and the fourth edge E4 are perpendicular to the first edge E1; and an axis 118 between the first edge E1 and the second edge E3, wherein the axis 118 is parallel to the first edge E1.

In an aspect, the front side 100F includes a first region of area X2×Y1 located on the front side 100F, extending between the first edge E1 and the axis 118 and from the third edge E3 to the fourth edge E4, wherein the first region of area X2×Y1 is covered by the first metallic layer 104; and wherein the cutout 108 is located at a center of the axis 118.

In an aspect, the open-ended microstrip transmission line 112-TL includes a metallic band 112 which extends from the second edge E2 to the axis 118; and wherein the feed line 124 is connected to the metallic band 112 at the second edge E2.

In an aspect, the center leg 106-C has a first width Y4, the cutout has the first width Y4, and the metallic band 112 has a second width Y3, wherein the second width Y3 is smaller than the first width Y4.

In an aspect, a length of the metallic band 112 is less than or equal to 12 mm and the second width Y3 is less than or equal to 4 mm.

In an aspect, the front side 100F further includes a metallic contact pad 120 located at a corner formed by the third edge E3 and the second edge E2, wherein a positive voltage source is connected to the metallic contact pad 120; a first contactor 114-C1 of the first choke 114 connected to the metallic contact pad 120; a second contactor 114-C2 of the first choke 114 connected through a via in the dielectric circuit board 102 to the second metallic layer 126; wherein the first choke 114 comprises a first resistor 114-R and a first inductor 114-L.

In an aspect, the front side 100F further includes wherein the second choke 116 is connected between a ground line at the second edge E2 and the first metallic layer 104, wherein the second choke 116 comprises a second resistor 116-R and a second inductor 116-L.

In an aspect, the first plurality of connected legs further includes the first leg 106-1 extending from the first edge E1 and parallel to the third edge E3; a second leg 106-2 perpendicular to the first leg 106-1 and extending towards the fourth edge E4; a third leg E3 parallel to the first leg 106-1; a fourth leg 106-4 perpendicular to the third leg 106-3 and extending towards the fourth edge E4; a fifth leg 106-5 parallel to the third leg 106-3 and extending towards the cutout 108; the center leg 106-C perpendicular to the fifth leg 106-5 and extending towards the fourth edge E4; a sixth leg 106-6 parallel to the fifth leg 106-5; a seventh leg 106-7 perpendicular to the sixth leg 106-6 and extending towards the fourth edge E4; an eighth leg 106-8 parallel to the sixth leg 106-6; a ninth leg 106-9 perpendicular to the eighth leg 106-8 and extending towards the fourth edge E4; the last leg 106-L parallel to the eighth leg 106-8 and extending to the first edge E1.

In an aspect, the second plurality of connected legs further includes the first leg 106B-1 extending from the first edge E1 and parallel to the third edge E3; a tenth leg 106B-10 perpendicular to the first leg 106B-1 and extending towards the fourth edge E4; an eleventh leg 106B-11 parallel to the first leg 106B-1; a twelfth leg 106B-11 perpendicular to the eleventh leg 106B-11 and extending towards the fourth edge E4; a thirteenth leg 106B-13 parallel to the eleventh leg 106B-11; a fourteenth leg 106B-14 perpendicular to the thirteenth leg 106B-13 and extending towards the fourth edge E4; a fifteenth leg 106B-15 parallel to the thirteenth leg 106B-13; a sixteenth leg 106B-16 perpendicular to the fifteenth leg 106B-15 and extending towards the fourth edge E4; a seventeenth leg 106B-17 parallel to the fifteenth leg 106B-15; an eighteenth leg 106B-18 perpendicular to the seventeenth leg 106B-17 and extending towards the fourth edge E4; the last leg 106B-L parallel to the seventeenth leg 106B-17 and extending to the first edge E1; and a nineteenth leg 106B-19 connected between the eleventh leg 106B-11 and the seventeenth leg 106B-17.

In an aspect, the second contactor 114-C2 of the first choke 114 is located between the eleventh leg 106B-11 and the first leg 106B-1, and within two millimeters of the tenth leg 106B-10; the first choke 114 has a first inductance 114-L, and a first resistance, 114-R, and the second choke 116 has a second inductance 116-L, and a second resistance 116-R.

In an aspect, a dielectric circuit board 102 width Y1 parallel to the first edge E1 is less than or equal to 27 mm, and a dielectric circuit board 102 length X1 parallel to the third edge E3 is less than or equal to 27 mm.

In an aspect, the meandering slot 106 and 106B is configured to radiate in dual-frequency bands comprising a first frequency band in a range of 730 MHz to 965 MHz and a second frequency band in a range of 1250 MHz to 1940 MHz.

In an aspect, a capacitance of the variable reverse bias varactor diode 110 is configured to be adjustable in a range between 0.84 pF to 5.08 pF, wherein adjusting the range of the capacitor changes the resonance frequency of the antenna 100.

The second embodiment is illustrated with respect to FIGS. 1A-1D. The second embodiment describes a method for forming a frequency reconfigurable miniaturized folded slot-based antenna 100. The method includes partially covering a front side 100F of a dielectric circuit board 102 with a metallic sheet 104. The method further includes wrapping the metallic sheet 104 over a first edge E1 of the dielectric circuit board 102 to a back side 100B of the dielectric circuit board 102.

In an aspect, the method further includes completely covering the back side 100B of the dielectric circuit board 102 with the metallic sheet 126.

In an aspect, the method further includes forming a meandering slots 106 and 106B in the metallic sheet 104 and 126.

In an aspect, the method further includes forming a cutout 108 in the metallic sheet 104 on the front side 100F.

In an aspect, the method further includes connecting a variable reverse bias varactor diode 110 across a center leg 106-C of the meandering slot 106.

In an aspect, the method further includes forming a metallic band 112 on the front side of the dielectric circuit board 102, wherein the metallic band 112 extends from a second edge E2 to an axis 118, wherein the second edge E2 and the axis 118 are parallel to the first edge E1.

In an aspect, the method further includes connecting a feed line 124 to the metallic band 112 at the second edge E2.

In an aspect, the method further includes connecting a first choke 114 between a positive voltage source and the metallic sheet 126 on the back side.

In an aspect, the method further includes connecting a second choke 116 between a ground line and the metallic sheet 104 on the front side 100F; wherein the first choke 114 and the second choke 116 are configured to bias the reconfigurable miniaturized folded slot-based antenna 100.

In an aspect, the method further includes forming a metallic contact pad 120 at a corner formed by the second edge E2 and a third edge E3 perpendicular to the second edge E2.

In an aspect, the method further includes connecting a positive voltage source to the metallic contact pad 120.

In an aspect, the method further includes connecting a first contactor 114-C1 of a first choke 114 of the plurality of chokes to the metallic contact pad 120.

In an aspect, the method further includes connecting a second contactor 114-C2 of the first choke 114 through a via in the dielectric circuit board 102 to the metallic sheet 126 on the back side 100B.

In an aspect, the method further includes a step of connecting a second choke 116 of the plurality of chokes between a ground line located at the second edge E2 and the metallic sheet 104 on the front side 100F.

In an aspect, the method further includes a step of forming the meandering slot 106 and 106B to have a first plurality of connected legs on the front side 100F of the dielectric circuit board 102 and a second plurality of connected legs on the back side 100B of the dielectric circuit board 102; wherein the first plurality of connected legs includes a first leg 106-1 extending from the first edge E1 and parallel to the third edge E3; a second leg 106-2 perpendicular to the first leg 106-1 and extending towards a fourth edge E4 parallel to the third edge E3; a third leg 106-3 parallel to the first leg 106-1; a fourth leg 106-4 perpendicular to the third leg 106-3 and extending towards the fourth edge E4; a fifth leg 106-5 parallel to the third leg 106-3 and extending towards the cutout 108; a center leg 106-C perpendicular to the fifth leg 106-5 and parallel to the cutout 108, the center leg 106-C extending towards the fourth edge 106-4; a sixth leg 106-6 parallel to the fifth leg 106-5; a seventh leg 106-7 perpendicular to the sixth leg 106-6 and extending towards the fourth edge E4; an eighth leg 106-8 parallel to the sixth leg 106-6; a ninth leg 106-9 perpendicular to the eighth leg 106-8 and extending towards the fourth edge E4; the last leg 106-L parallel to the eighth leg 106-8 and extending to the first edge E1; wherein the second plurality of connected legs includes: the first leg 106B-1 extending from the first edge E1 and parallel to the third edge E3; a tenth leg 106B-10 perpendicular to the first leg 106B-1 and extending towards the fourth edge E4; an eleventh leg 106B-11 parallel to the first leg E1; a twelfth leg 106B-12 perpendicular to the eleventh leg 106B-11 and extending towards the fourth edge E4; a thirteenth leg 106B-13 parallel to the eleventh leg 106B-11; a fourteenth leg 106B-14 perpendicular to the thirteenth leg 106B-13 and extending towards the fourth edge E4; a fifteenth leg 106B-15 parallel to the thirteenth leg 106B-13; a sixteenth leg 106B-16 perpendicular to the fifteenth leg 106B-15 and extending towards the fourth edge E4; a seventeenth leg 106B-17 parallel to the fifteenth leg 106B-15; an eighteenth leg 106B-18 perpendicular to the seventeenth leg 106B-17 and extending towards the fourth edge E4; the last leg 106B-L parallel to the seventeenth leg 106B-17 and extending to the first edge E1; and a nineteenth leg 106B-19 connected between the eleventh leg 106B-11 and the seventeenth leg 106B-17.

The third embodiment is illustrated with respect to FIGS. 1A-1B. The third embodiment describes a method of adjusting a resonance frequency of a frequency reconfigurable miniaturized folded slot-based antenna 100. The method includes applying a bias voltage to a first choke 114 connected between a contact pad 120 on a front side 100F of a dielectric circuit board 102 to a metallic sheet 126 covering a backside 100B of a dielectric circuit board 102, wherein the metallic sheet 126 is wrapped around the backside 100B to the front side 100F, and partially covers the front side 100F. The method further includes applying a signal to a feed line 124 connected to a metallic band 112 located between an uncovered area X5×Y3 of the front side 100F and a cutout 108 in the metallic sheet 104 on the front side 100F. The method further includes adjusting a capacitance of a variable reverse bias varactor diode 110 located across a center leg 106-C of a meandering slot 106 formed in the metallic sheet 104.

To this end, the present disclosure describes a compact meandered folded slot-based antenna for use in 5G enabled NB-IoT and LTE-M applications. The antenna consists of a folded slot structure with a varactor diode loading. The antenna operates over dual-bands with wide frequency sweeps from 730~965 MHZ and 1250~1940 MHz. Any resonating band can be obtained merely by adjusting the reverse bias voltage across the terminals of the varactor diode. A plurality of miniaturization techniques are integrated together to achieve a compact antenna design to operate at sub-1 GHz bands with an antenna dimension of 27×27 $mm^2$. The proposed antenna structure is best suited for multi-standards 5G enabled IoT devices.

Obviously, numerous modifications and variations of the present disclosure will be apparent to the person skilled in the art in light of the above description. For example, number of leges could be increased or decreased to improve the radiation efficiency of the antenna design. Also, the length and width of various elements such as meandering slots, legs, open-ended microstrip transmission line, values of the resistance and inductance of plurality of chokes were used while preparing the antenna of the present disclosure. It is therefore to be understood that within the scope of the appended claims, the disclosure may be practiced otherwise than as specifically described herein.

The invention claimed is:

1. A frequency reconfigurable miniaturized folded slot-based antenna for use with Internet of Things (IoT) devices, comprising:

a circuit board having a front side and a back side separated by a dielectric layer;

the front side including:

a first metallic layer configured with a meandering slot having a first plurality of connected legs including at least a first leg, a center leg, and a last leg;

a cutout in the first metallic layer;

a variable reverse bias varactor diode connected across the center leg, wherein the center leg is parallel to the cutout;

an open-ended microstrip transmission line configured to receive a signal from a feed line;

a first choke and a second choke;

the back side including:

a second metallic layer configured to cover the back side and to connect with the first metallic layer at a first edge of the circuit board;

a continuation of the meandering slot formed in the second metallic layer, wherein the second metallic layer includes a second plurality of connected legs, wherein a first leg and a last leg of the second plurality of connected legs is connected to the first leg and the last leg of the first plurality of connected legs at the first edge; and wherein the meandering slot is configured to resonate at signal frequencies dependent on a setting of the variable reverse bias varactor diode.

2. The frequency reconfigurable miniaturized folded slot-based antenna of claim 1, wherein the circuit board comprises:

a second edge parallel to the first edge;

a third edge parallel to a fourth edge, wherein the third edge and the fourth edge are perpendicular to the first edge; and an axis between the first edge and the second edge, wherein the axis is parallel to the first edge.

3. The frequency reconfigurable miniaturized folded slot-based antenna of claim 2, wherein the front side further comprises:

a first region located on the front side, extending between the first edge and the axis and from the third edge to the fourth edge, wherein the first region is covered by the first metallic layer; and wherein the cutout is located at a center of the axis.

4. The frequency reconfigurable miniaturized folded slot-based antenna of claim 3, wherein the open-ended microstrip transmission line comprises:

a metallic band which extends from the second edge to the axis; and wherein the feed line is connected to the metallic band at the second edge.

5. The frequency reconfigurable miniaturized folded slot-based antenna of claim 4, wherein the center leg has a first width, the cutout has the first width, and the metallic band has a second width, wherein the second width is smaller than the first width.

6. The frequency reconfigurable miniaturized folded slot-based antenna of claim 5, wherein a length of the metallic band is less than or equal to 12 mm and the second width is less than or equal to 4 mm.

7. The frequency reconfigurable miniaturized folded slot-based antenna of claim 5, wherein the front side further comprises:

a metallic contact pad located at a corner formed by the third edge and the second edge, wherein a positive voltage source is connected to the metallic contact pad;

a first contactor of the first choke connected to the metallic contact pad;

a second contactor of the first choke connected through a via in the circuit board to the second metallic layer;

wherein the first choke comprises a first resistor and a first inductor.

8. The frequency reconfigurable miniaturized folded slot-based antenna of claim 7, wherein the front side further comprises:

wherein the second choke is connected between a ground line at the second edge and the first metallic layer, wherein the second choke comprises a second resistor and a second inductor.

9. The frequency reconfigurable miniaturized folded slot-based antenna of claim 8, wherein the first plurality of connected legs further comprises:

the first leg extending from the first edge and parallel to the third edge;

a second leg perpendicular to the first leg and extending towards the fourth edge;

a third leg parallel to the first leg;

a fourth leg perpendicular to the third leg and extending towards the fourth edge;

a fifth leg parallel to the third leg and extending towards the cutout;

the center leg perpendicular to the fifth leg and extending towards the fourth edge;

a sixth leg parallel to the fifth leg;

a seventh leg perpendicular to the sixth leg and extending towards the fourth edge;

an eighth leg parallel to the sixth leg;

a ninth leg perpendicular to the eighth leg and extending towards the fourth edge;

the last leg parallel to the eighth leg and extending to the first edge.

10. The frequency reconfigurable miniaturized folded slot-based antenna of claim 9, wherein the second plurality of connected legs further comprises:

the first leg extending from the first edge and parallel to the third edge;

a tenth leg perpendicular to the first leg and extending towards the fourth edge;

an eleventh leg parallel to the first leg;

a twelfth leg perpendicular to the eleventh leg and extending towards the fourth edge;

a thirteenth leg parallel to the eleventh leg;

a fourteenth leg perpendicular to the thirteenth leg and extending towards the fourth edge;

a fifteenth leg parallel to the thirteenth leg;

a sixteenth leg perpendicular to the fifteenth leg and extending towards the fourth edge;

a seventeenth leg parallel to the fifteenth leg;

an eighteenth leg perpendicular to the seventeenth leg and extending towards the fourth edge;

the last leg parallel to the seventeenth leg and extending to the first edge; and a nineteenth leg connected between the eleventh leg and the seventeenth leg.

11. The frequency reconfigurable miniaturized folded slot-based antenna of claim 10, wherein:

on the back side, the second contactor of the first choke is located between the eleventh leg and the last leg, and within two millimeters of the tenth leg;

the first choke has a first inductance, and a first resistance, and the second choke has a second inductance, and a second resistance.

12. The frequency reconfigurable miniaturized folded slot-based antenna of claim 1, wherein a circuit board width parallel to the first edge is less than or equal to 27 mm and a circuit board length parallel to the third edge is less than or equal to 27 mm.

13. The frequency reconfigurable miniaturized folded slot-based antenna of claim 1, wherein the meandering slot is configured to radiate in dual frequency bands comprising a first frequency band in a range of 730 MHz to 965 MHz and a second frequency band in a range of 1250 MHz to 1940 MHz.

14. The frequency reconfigurable miniaturized folded slot-based antenna of claim 13, wherein a capacitance of the variable reverse bias varactor diode is configured to be adjustable in a range between 0.84 pF to 5.08 pF, wherein adjusting the range of the capacitor changes a resonance frequency of the antenna.

15. A method for forming a frequency reconfigurable miniaturized folded slot-based antenna, comprising:

partially covering a front side of a dielectric circuit board with a metallic sheet;

wrapping the metallic sheet over a first edge of the dielectric circuit board to a back side of the dielectric circuit board;

completely covering the back side of the dielectric circuit board with the metallic sheet;

forming a meandering slot in the metallic sheet;

forming a cutout in the metallic sheet on the front side;

connecting a variable reverse bias varactor diode across a center leg of the meandering slot;

forming a metallic band on the front side of the dielectric circuit board, wherein the metallic band extends from a second edge to an axis, wherein the second edge and the axis are parallel to the first edge; and connecting a feed line to the metallic band at the second edge.

16. The method for forming a frequency reconfigurable miniaturized folded slot-based antenna of claim 15, further comprising:

connecting a first choke between a positive voltage source and the metallic sheet on the back side;

connecting a second choke between a ground line and the metallic sheet on the front side; and wherein the first choke and the second choke are configured to bias the reconfigurable miniaturized folded slot-based antenna.

17. The method for forming a frequency reconfigurable miniaturized folded slot-based antenna of claim 15, further comprising:

forming a metallic contact pad at a corner formed by the second edge and a third edge perpendicular to the second edge;

connecting a positive voltage source to the metallic contact pad;

connecting a first contactor of a first choke of the plurality of chokes to the metallic contact pad; and connecting a second contactor of the first choke through a via in the dielectric circuit board to the metallic sheet on the back side.

18. The method for forming a frequency reconfigurable miniaturized folded slot-based antenna of claim 17, further comprising connecting a second choke of the plurality of chokes between a ground line located at the second edge and the metallic sheet on the front side.

19. The method for forming a frequency reconfigurable miniaturized folded slot-based antenna of claim 17, further comprising:

forming the meandering slot to have a first plurality of connected legs on the front side of the dielectric circuit board and a second plurality of connected legs on the back side of the dielectric circuit board;

wherein the first plurality of connected legs includes:

a first leg extending from the first edge and parallel to the third edge;

a second leg perpendicular to the first leg and extending towards a fourth edge parallel to the third edge;

a third leg parallel to the first leg;

a fourth leg perpendicular to the third leg and extending towards the fourth edge;

a fifth leg parallel to the third leg and extending towards the cutout;

a center leg perpendicular to the fifth leg and parallel to the cutout, the center leg extending towards the fourth edge;

a sixth leg parallel to the fifth leg;

a seventh leg perpendicular to the sixth leg and extending towards the fourth edge;

an eighth leg parallel to the sixth leg;

a ninth leg perpendicular to the eighth leg and extending towards the fourth edge;

the last leg parallel to the eighth leg and extending to the first edge;

wherein the second plurality of connected legs includes:

the first leg extending from the first edge and parallel to the third edge;

a tenth leg perpendicular to the first leg and extending towards the fourth edge;

an eleventh leg parallel to the first leg;

a twelfth leg perpendicular to the eleventh leg and extending towards the fourth edge;

a thirteenth leg parallel to the eleventh leg;

a fourteenth leg perpendicular to the thirteenth leg and extending towards the fourth edge;

a fifteenth leg parallel to the thirteenth leg;

a sixteenth leg perpendicular to the fifteenth leg and extending towards the fourth edge;

a seventeenth leg parallel to the fifteenth leg;

an eighteenth leg perpendicular to the seventeenth leg and extending towards the fourth edge;

the last leg parallel to the seventeenth leg and extending to the first edge; and a nineteenth leg connected between the eleventh leg and the seventeenth leg.

20. A method of adjusting a resonance frequency of a frequency reconfigurable miniaturized folded slot-based antenna, comprising:

applying a bias voltage to a first choke connected between a contact pad on a front side of a dielectric circuit board to a metallic sheet covering a back side of a dielectric circuit board, wherein the metallic sheet is wrapped around the back side to the front side, and partially covers the front side;

grounding a second choke connected between a ground connection and metallic sheet located on the front side;

applying a signal to a feed line connected to a metallic band located between an uncovered area of the front side and a cutout in the metallic sheet on the front side; and adjusting a capacitance of a variable reverse bias varactor diode located across a leg of a meandering slot formed in the metallic sheet.

* * * * *